US006279907B1

(12) United States Patent
Hullinger

(10) Patent No.: US 6,279,907 B1
(45) Date of Patent: Aug. 28, 2001

(54) SPACIAL GAME BOARD WITH SPACIAL CHESS AND SPACIAL CHECKERS

(76) Inventor: Marvin Douglas Hullinger, 14426 Beverly Park Rd. #2, Edmonds, WA (US) 98026

( * ) Notice: Subject to any disclaimer, the term of this patent is extended or adjusted under 35 U.S.C. 154(b) by 0 days.

(21) Appl. No.: 09/231,461

(22) Filed: Jan. 14, 1999

(51) Int. Cl.[7] ..... A63F 3/02

(52) U.S. Cl. ..... 273/241; 273/260; 273/261; 273/283; D21/336; D21/337; D21/348; D21/349

(58) Field of Search ..... 273/287, 236, 273/241, 260, 261, 283, 284; D21/336, 337, 348, 349

(56) References Cited

U.S. PATENT DOCUMENTS 4,099,723 * 7/1978 Robinson .
4,147,359 * 4/1979 King .
4,179,127 * 12/1979 Goodman .
4,696,476 * 9/1987 Eplett .
4,861,040 * 8/1989 Peterson .
5,112,056 * 5/1992 Ching .
5,358,252 * 10/1994 McPhaul .
5,456,472 * 10/1995 Goodman .
5,662,329 * 9/1997 Nason .

* cited by examiner

*Primary Examiner*—Benjamin H. Layno

(57) ABSTRACT

The Spacial Game Board is a contiguous, multi-level (variable quantity and variably locatable in some cases) game board of squares with the quantity of simultaneous players determined by the quantity of squares being played on (2 players~64 squares, 4 players~133, or 144 squares, multiple player pairs additional to 2 add 72 squares for each pair) used for playing Spacial Chess and Spacial Checkers (Two Kingdom, Four Kingdom, etc., where Kingdom quantity matches the number of simultaneous players) that has additional rules to the traditional rules of chess and checkers when four or more simultaneous players are conducting a match whether on hardware (real life playing surface) or via computer generated Spacial Game Board with Spacial Chess and Spacial Checkers software packages.

25 Claims, 10 Drawing Sheets

SPACIAL GAME BOARD WITH SPACIAL CHESS AND SPACIAL CHECKERS

SPECIFICATION

DESCRIPTIVE TITLE OF INVENTION

Spacial Game Board, a contiguous, multilevel (variable quantity and variably locatable in some cases), playing board of squares used for Two (player) Kingdom (64 squares), Four (player) Kingdom (squares of 136 or, 144), and multiple Kingdom (beyond Four players, in groups of two (square quantity increased by 72 for each additional two players)) Spacial Chess and Checkers on real life hard ware or in computer generated Spacial Game Board with Spacial Chess and Spacial Checkers software packages.

CROSS REFERENCE TO RELATED APPLICATIONS

Chessboard, checker board; the game of Chess, the game of Checkers

STATEMENT REGARDING FED SPONSORED R & D

There is no Fed sponsored R & D.

REFERENCE TO MICROFICHE APPENDIX

There is no reference to the Microfiche appendix.

BACKGROUND OF THE INVENTION

Having grown up playing chess, I recently wondered how to make the game more challenging. I thought about the flat game board, how to change it so that an additional challenge of spatiality could be incorporated. By adding various contiguous height variations, the game pieces would not lie on one flat plane. Rather, they would lie on contiguous squares of varying heights. A variation of the word spatial is the word spacial. I named my creation the SPACIAL GAME BOARD.

The seating arrangement in a sports arena, where each row of seats are in ascending, contiguous levels of height is an example of the spatial game board "stair step" height variation.

I also wanted to create a way that two couples, or four people could play chess at the same time. This would entail the use of two sets of chess pieces, or four kingdoms. The FOUR KINGDOM SPACIAL GAME BOARD would need to be larger than the consolidation of two standard (64 square) game boards. This will provide some space between adjacent kingdoms at the beginning of the game; at setup (standard layout of pawns and other pieces that form a total of two rows of pieces). Having more than four players playing at one time could be incorporated by adding more squares, 72 for each additional pairs of players. I can envision a large table with a game board of 352 squares (on various contiguous levels) and ten players enjoying a "long-play-time" game. I can also envision ten players playing the same game board but, each player is in their own home and are "modemed" to my Spacial Chess and Spacial Checkers Webpage and playing in cyberspace.

Being a wood worker, I felt that the spacial game board prototypes should be made of wood. By setting various lengths of "2 by 4, 2 by 6, & 2 by 8" wood boards on their small side and, attaching them about a "2 by 4" cut to 3.5" length (laid flat on the large side), I created an ascending "stair step", or step of 1.5". The result is a box like structure with stair steps descending toward the middle from each side. I marked each board with a line every 1.5" down the length of the sides to form squares. This game board has a total of sixty-four squares, each (1.5"×1.5"). The exterior of the game board is (12"×12"). This was my first, although rough prototype. I used some scrap lumber, a circular hand saw for the cuts and, nailed the pieces together. No real wood finish work was done. The first prototype game board was so challenging that diagonal lines had to be drawn to aid in the discernment of the correct diagonal squares for a piece to move along.

The following spacial game board versions were made with clear Douglas Fir wood and with good woodworking shop tools to produce "furniture quality" pieces. All squares are formed by hand sawing (0.25") deep cuts on the small side (1.5") of each "2 by board in 1.5" intervals.

The second prototype was the Four Kingdom Spacial Game Board. This game board was made with eight wood boards of various heights when laid on their small side. All boards (25.5" in length) were ripcut from "2 by 4" wood, except the 4" height, which was cut from a "2 by 6". Four height variations (1.25", 2.25", 3.25", & 4") for eight boards were created (two of each height). I cut (0.25") deep lines into each top side of the boards with a hand saw. Seventeen "squares" were formed on each board as a result of the lines. This game board has a total of 136 squares (1.5"×1.5") formed by eight rows (of various height) of seventeen columns. If one were to make a letter association for each height (A~1.25", B~2.25", C~3.25", & D~4") and one were to look along the short side of the spacial game board table, one would see (as one example) the following height variation: DCBAABCD. Each of the eight boards can be placed in any row location so one can change the location of the various heights. For example; DBACCABD. I had named some of the variations in the disclosure document for this type of game board as Four Kingdom 4 Level Spacial Game Board with Valley elevation layout and with Multiple Hill elevation layout. I now call this game board the FOUR KINGDOM OPEN PLAIN SPACIAL GAME BOARD.

The SPACIAL GAME BOARD TABLE is a four legged table whose top is a box-like structure that holds the boards that form the spacial game board and provides shelf space for captured pieces. The table is 17.5" tall with a top that is 22" deep and 28.5" wide. There are two shelves that lie within the top box-like structure that are 25.5" long and 3.5" wide. The wood boards that form the Spacial Game Board sit between the two shelves and are held up by additional wood pieces that form the lower structure of the game board table. All versions of the Four Kingdom Spacial Game Board can be placed in the Spacial Game Board Table.

The third prototype was made with made with seventeen boards, each with eight "squares". Twelve inch long boards were ripcut to form height variations of (1.5", 2.5", 3.5", & 4"). The 136 squares (1.5"×1.5") are formed from eight rows with seventeen columns (various height), The result is four levels where there are two highest levels, five second highest, six third highest, and four the fourth highest. The boards can be placed anywhere on the game table so as to change the location of a certain level. The standard layout is to have three hills formed by the various levels so that two high hills are on either side of a smaller hill. If one were to assign a letter to each height variation (1.5"~a, 2.5"~b, 3.5"~c, 4"~d) and to view the height variation along the long side of the spacial game board table; you would see: abcdcbabcbabcdcba. This game board lies on the spacial game board table. I called this version in the disclosure statement the Four Kingdom 4 Level 3 Mountain Transverse elevation layout. I now call this version the FOUR KINGDOM THREE HILL SPACIAL GAME BOARD.

The fourth prototype game board incorporated "2 by 4" wood boards. The center piece (2 by 4) cut to 3.5" in length is similar to the first prototype. The steps ascending from the center (arena configuration) were made with only one size of wood, the "2 by 4". The first step is 2" tall. Each following step is 1.5" tall. This prototype also created, when turned upside down (mountain configuration), a top center with descending steps.

Squares were formed by sawing lines every 1.5" along the step's top side. No diagonal lines were drawn. A total of sixty-four squares (1.5"×1.5") were formed. This piece is 12" wide by 12" deep with a height of 8". A sleeve made of "2 by 4" wood holds the game board in place. The sleeve is (9"×9"×3.5"). In the Arena configuration the center slides through the sleeve and the "stair step" rests on it's top. The total height of the game board as mounted on the sleeve in the arena configuration is 8.5". In the mountain configuration, the game board rests on the sleeve. The resultant total height (mountain configuration) is 10". I call this version the TWO KINGDOM ARENA/MOUNTAIN SPACIAL GAME BOARD.

The fifth prototype took the idea of the Two Kingdom Arena/Mountain Spacial Game Board and made a Four Kingdom version. Rather than a center with three steps, this game board has five steps, each 1.5" tall. The resultant game board has 144 squares (1.5"×1.5"). This piece is 18" wide by 18" deep and is 9.5" tall. The sleeve that holds this game board is made of (2 by 6) board. The sleeve is (12"×12"×5.5"). The game board, in the arena configuration mounted on the sleeve is 12" tall. The game board can be turned upside down to form the mountain configuration. In this configuration, mounted on the sleeve, the total height is 12". This game board in the arena configuration, or the mountain configuration can also be placed in the Spacial Game Board Table

BRIEF SUMMARY OF THE INVENTION

The Spacial Game Board is a contiguous multi-level (variably locatable) game board of squares used for playing Two Kingdom (two player), Four Kingdom (four player), or Multiple Kingdom (player quantity greater than four in additions of two) Spacial Chess and Spacial Checkers.

The Spacial Game Board creates a more challenging game board by incorporating spatiality to that which was traditionally a flat (two-dimensional) game board. The multiple levels are contiguous in that if one were to view the game board in a vertical axis centered on the game board, he would only see a number of squares, as though they were on a flat game board. It is when a person views the spacial game board from a player's view that the spatiality becomes apparent since he sees various levels of squares.

Two Kingdom Spacial Chess, Two Kingdom Spacial Checkers, and Four Kingdom Spacial Checkers, currently, do not have any special rules in addition to the rules for the common chess and checkers games. Four Kingdom Chess has additional rules to common chess one of which allows a kingdom in checkmate to remain "alive" for one round (every player taking one turn) in hope that another player will capture the piece that put this player in checkmate.

The Spacial Game Board can be real-life hardware and it can be a computer generated game board in cyberspace. The bitboard (Boolean representation) will be of a size sufficient to represent the various quantities of squares.

BRIEF DESCRIPTION OF THE DRAWINGS a. FIG. 1. The first spacial game board prototype.

b. FIG. 2. The Spacial Game Board Family. (A picture of the four furniture grade prototypes.)

c. FIG. 3. The Spacial Game Board Logo.

d. FIG. 4. The Four Kingdom Spacial Chess Logo.

e. FIG. 5. The Four Kingdom Spacial Checkers Logo.

f. FIG. 6. The Two Kingdom Spacial Chess Logo.

g. FIG. 7. The Two Kingdom Spacial Checkers Logo.

h. FIG. 8. The Four Kingdom Open Plain Spacial Game Board.

i. FIG. 9. The Four Kingdom Open Plain Spacial Game Board with setup variations.

j. FIG. 10. The Spacial Game Board Table.

k. FIG. 11. The Four Kingdom Three Hill Spacial Game Board.

l. FIG. 12. The Four Kingdom Arena-Mountain Spacial Game Board, Arena Configuration, on the Spacial Game Board Table.

m. FIG. 13. The Four Kingdom Arena-Mountain Spacial Game Board, Mountain Configuration, on the Spacial Game Board Table.

n. FIG. 14. The Four Kingdom Arena-Mountain Spacial Game Board, Arena Configuration on the Sleeve.

o. FIG. 15. The Four Kingdom Arena-Mountain Spacial Game Board, Mountain Configuration, on the Sleeve.

p. FIG. 16. The Two Kingdom Arena-Mountain Spacial Game Board, Arena Configuration, on the Sleeve.

q. FIG. 17. The Two Kingdom Arena-Mountain Spacial Game Board, Mountain Configuration, on the Sleeve.

r. FIG. 18. The All Terrain Spacial Game Board Square ID Number.

s. FIG. 19. The All Terrain Spacial Game Board Square/Level Piece Layout.

DETAILED DESCRIPTION

The Spacial Game Board is a contiguous multi-level (variably locatable) game board of squares used for playing Two Kingdom (two player), Four Kingdom (four player), or Multiple Kingdom (player quantity greater than four in additions of two) Spacial Chess and Spacial Checkers.

The Spacial Game Board creates a more challenging game board by incorporating spatiality to that which was traditionally a flat (two-dimensional) game board. The multiple levels are contiguous in that if one were to view the game board in a vertical axis centered on the game board, he would only see a number of squares, as though they were on a flat game board. It is when a person views the spacial game board from a player's view that the spatiality becomes apparent since he sees various levels of squares.

Multiples of greater than four players can be played on larger game boards than those of the prototypes. These gameboards could be constructed using multiples of the prototype game boards.

Two Kingdom Spacial Chess, Two Kingdom Spacial Checkers, and Four Kingdom Spacial Checkers, currently, do not have any special rules in addition to the rules for the common chess and checkers games. Four Kingdom, and Multiple Kingdom Chess have additional rules relative to common chess, one of which allows a kingdom in checkmate to remain "alive" for one round (every player taking one turn) in hope that another player will capture the piece that put this player in checkmate.

The Spacial Game Board is real-life hardware and it can also be a computer generated game board in cyberspace. The bitboard (Boolean representation) will be of a size sufficient to represent the various quantities of squares. I will create a webpage, where the Spacial Game Board(s) can be accessed and users play against the computer or other users Two Kingdom, Four Kingdom, or Multiple Kingdom Spacial Chess or Spacial Checkers.

The computer software for the Spacial Chess and Spacial Checkers will require various bitboard sizes. The bitboard size required for each type of two, four, or multiple kingdom games matches the quantity of squares of the game board. This bitboard is a Boolean representation of the game board. A two kingdom bit board would be a 64 bit word. A four kingdom bit board, depending on the type of game board would be a 136 bit word, or a 144 bit word. A multiple kingdom bit board for six players would be a 208 (136+72) bit word, or a 216 (144+72) bit word. A ten player multiple kingdom bit board would be a 352[136+(3)72] bit word, or a 360[144+(3)72] bit word.

There are many kinds of bitboards, one to represent the initial position of all the pieces at the beginning of the game, one of the initial position of each kingdoms pieces, one of each type of piece(rook, knight, queen, etc.), and many more including rotated bit boards(or attack boards). Operations performed on bitboards include and (both bits set), or (one or both bits set), and or (only one bit set, not both).

My computer chess and checkers software will follow a tree search methodology. By creating search functions the computer can choose the "best" move in a given situation. This will allow users to play against the computer.

I have included the previous description of the computer software version of the Spacial Game Board for Spacial Chess and Spacial Checkers because I want the patent to cover the Spacial Game Board, Two Kingdom Spacial Chess, Two Kingdom Spacial Checkers, Four Kingdom Spacial Chess, Four Kingdom Spacial Checkers, Multiple Kingdom Spacial Chess, and Multiple Kingdom Spacial Checkers in a computerized version.

The spacial game board prototypes are made of wood. Other materials could be used, I like the look and feel of wood. The following description of the prototypes includes reference to seventeen figures, or pictures (most of which are copies of photos of the prototypes) by including the figure number in the description.

The first prototype (FIG. 1) was made by setting various lengths of "2 by 4, 2 by 6, & 2 by 8" wood boards on their small side and, attaching them about a "2 by 4" cut to 3.5" length (laid flat on the large side), I created an ascending "stair step", or step of 1.5". The result is a box like structure with stair steps descending toward the middle from each side. I marked each board with a line every 1.5" down the length of the sides to form squares. This game board has a total of sixty-four squares, each (1.5"×1.5"). The exterior of the game board is (12"×12"). This was my first, although rough prototype. I used some scrap lumber, a circular hand saw for the cuts and, nailed the pieces together. No real wood finish work was done. The first prototype game board was so challenging that diagonal lines had to be drawn to aid in the discernment of the correct diagonal squares for a piece to move along.

The following spacial game board versions were made with clear Douglas Fir wood and with good woodworking shop tools to produce "furniture quality" pieces. All squares are formed by hand sawing (0.25") deep cuts on the small side (1.5") of each "2 by board" in 1.5" intervals. There are no diagonal lines to aid in the discernment of the correct diagonal squares to move along; the more challenging game board has been found.

The second prototype was the Four Kingdom Spacial Game Board. I now call this game board the FOUR KINGDOM OPEN PLAIN SPACIAL GAME BOARD (FIG. 8). This game board was made with eight wood boards of various heights when laid on their small side. All boards (25.5" in length) were ripcut from "2 by 4" wood, except the 4" height, which was cut from a "2 by 6". Four height variations (1.25", 2.25", 3.25", & 4") for eight boards were created (two of each height). I cut (0.25") deep lines into each top side of the boards with a hand saw. Seventeen "squares" were formed on each board as a result of the lines. This gameboard has a total of 136 squares (1.5"×1.5") formed by eight rows(of various height) of seventeen columns. If one were to make a letter association for each height (A~1.25", B~2.25", C~3.25", & D~4") and one were to look along the short side of the spacial game board table, one would see (as one example) the following height variation: DCBAABCD. Each of the eight boards can be placed in any row location so one can change the location of the various heights. For example; DBACCABD. I had named some of the variations in the disclosure document for this type of game board as Four Kingdom 4 Level Spacial Game Board with Valley elevation layout and with Multiple Hill elevation layout. Level location variation can be seen in FIG. 9, where you will note that the pieces advance down toward the center in the top photo but, advance upward toward the center in the bottom photo.

The SPACIAL GAME BOARD TABLE (FIG. 10) is a four legged table whose top is a box-like structure that holds the boards that form the spacial game board and provides shelf space for captured pieces. The table, is 17.5" tall with a top that is 22" deep and 28.5" wide. There are two shelves that lie within the top box-like structure that are 25.5" long and 3.5" wide. The wood boards that form the Spacial Game Board sit between the two shelves and are held up by additional wood pieces that form the lower structure of the game board table. All versions of the Four Kingdom Spacial Game Board can be placed in the Spacial Game Board Table.

The third prototype was made with made with seventeen boards, each with eight "squares". I now call this version the FOUR KINGDOM THREE HILL SPACIAL GAME BOARD (FIG. 11). Twelve inch long boards were ripcut to form height variations of (1.5", 2.5", 3.5", & 4"). The 136 squares (1.5"×1.5") are formed from eight rows with seventeen columns (various height), The result is four levels where there are two highest levels, five second highest, six third highest, and four the fourth highest. The boards can be placed anywhere on the game table so as to change the location of a certain level. The standard layout is to have three hills formed by the various levels so that two high hills are on either side of a smaller hill. If one were to assign a letter to each height variation (1.5"~a, 2.5"~b, 3.5"~c, 4"~d) and to view the height variation along the long side of the spacial game board table; you would see: abcdcbab babcdcba. This game board lies on the spacial game board table. I called this version in the disclosure statement the Four Kingdom 4 Level 3 Mountain Transverse elevation layout.

The fourth prototype game board incorporated "2 by 4" wood boards. I call this version the TWO KINGDOM ARENA/MOUNTAIN SPACIAL GAME BOARD (FIG. 12). The center piece (2 by 4) cut to 3.5" in length is similar to the first prototype. The steps ascending from the center (arena configuration) were made with only one size of wood, the "2 by 4". The first step is 2" tall. Each following step is 1.5" tall. This prototype also created, when turned upside down (mountain configuration), a top center with descending steps. Squares were formed by sawing lines every 1.5" along the step's top side. No diagonal lines were drawn. A total of sixty-four squares (1.5"×1.5") were formed. This piece is 12" wide by 12" deep with a height of 8". A sleeve made of "2 by 4" wood holds the game board in place (FIG. 2). The sleeve is (9"×9"×3.5"). In the Arena configuration the center slides through the sleeve and the "stair step" rests on it's top. The total height of the game board as mounted on the sleeve in the arena configuration is 8.5" (FIG. 16). In the mountain configuration, the game board rests on the sleeve. The resultant total height (mountain configuration) is 10" (FIG. 17).

The fifth prototype took the idea of the Two Kingdom Arena/Mountain Spacial Game Board and made a Four Kingdom version. I call this version the FOUR KINGDOM ARENA-MOUNTAIN SPACIAL GAME BOARD. Rather than a center with three steps, this game board has five steps, each 1.5" tall. The resultant game board has 144 squares (1.5"×1.5"). This piece is 18" wide by 18" deep and is 9.5" tall. The sleeve that holds this game board is made of (2 by 6) board. The sleeve is (12"×12"×5.5"); note FIG. 2. The game board, in the arena configuration mounted on the sleeve is 12" tall (FIG. 14). The game board can be turned upside down to form the mountain configuration. In this configuration, mounted on the sleeve, the total height is 12" (FIG. 15). This game board in the arena configuration (FIG. 12), or the mountain configuration (FIG. 13) can also be placed in the Spacial Game Board Table.

The second through the fifth spacial game board prototype as well as the spacial game board table is shown in FIG. 2. The title of FIG. 2 is: 'The Spacial Game Board Family'. The first prototype could be included but, I wanted to show case the furniture quality prototypes.

Another type of Spacial Game Board is the ALL TERRAIN SPACIAL GAME BOARD (FIGS. 18, 19). I have not made the hard-copy of the prototype at the time of this document but, I intend on making it in the next couple of weeks. Construction of this prototype will consist of a piece of ¼" plywood (12" by 25½") that will lie within the Spacial Game Board Table (FIG. 10) in the same location as the game board square/level pieces set (FIG. 9, FIG. 11; the light colored wood pieces). The square/level pieces will sit atop the plywood.

The square/level pieces for the All Terrain Spacial Game Board will be pieces made from (2" by 2") wood, which is actually (1.5"×1.5"). The pieces will all be the size of a square (1.5"×1.5", as with all squares in the other prototypes), just the length (height level) will vary from piece to piece. In FIG. 18, you will note the Square ID Number, which indicates a number from 1 to 136 on each square. By this, the most upper left square is ID Number 1, the most lower right square ID Number is 136. The most upper right square ID Number is 17. One can locate any square by noting it's ID Number in FIG. 18.

FIG. 19 indicates one example of the All Terrain Spacial Game Board Square/Level Piece Layout with Square/Level pieces 5 (7.5" tall), 4 (6" tall), 3 (4.5" tall), 2 (3" tall), and 1 (1.5" tall). Each piece has a base of (1.5"×1.5"). Also, the top is a flat area of dimensions (1.5"×1.5"). This flat top area is the square (like the squares made from level pieces with grooves cut in them to form squares).

By locating square/level pieces (5, 4, 3, 2, & 1) at the corresponding location that indicates 1, 2, 3, 4, & 5 on the grid in FIG. 19, one can lay out the game board. According to FIG. 19, the most upper left piece (1) resides in Square ID Number 1 (FIG. 18). Also, piece (5) resides in Square ID Number 60. The result is a game board that could represent hilly terrain of land.

There could be more than 5 lengths of square/level pieces and the layout could vary by changing the location of the different pieces. This game board could be reduced in square quantity to 64 squares, or remain with 136 squares. By making a "ring" made of wood with a (1.5"×1.5") cross-section and, at any perimeter so sized to match the quantity of pieces, one could make a Multiple Kingdom Spacial Game Boards for any number of players. This game board could also be computer generated and a larger number of players (10 or more) could play on a variable-rectangular shaped computer generated game board with many levels (in excess of 5).

In summary, the Spacial Game Board used for playing Spacial Chess and Spacial Checkers is any contiguous, multi-level, game board of squares made in hard copy or, in a computer game. Spacial Chess and Spacial Checkers in the Two Kingdom, Four Kingdom, and Multiple Kingdom applications are made specifically for the Spacial Game Board (FIGS. 3, 4, 5, 6, & 7).

What is claimed is:

1. A four-player board game for playing chess or checkers comprising:

a plurality of playing pieces;

a plurality of elongated lumber pieces each having a length, a height and a width, said width and height of each lumber piece defining surfaces along the sides of the lumber pieces, said lumber pieces all having the same length and width;

said lumber pieces having different heights, wherein a first set of lumber pieces having a first height, a second set of lumber pieces having a second height which is greater than said first height, a third set of lumber pieces having a third height which is greater than said second height, and a fourth set of lumber pieces having a fourth height which is greater than said third height, said length of said lumber pieces is greater than said width and said heights;

said surface along the width of each lumber piece having demarcations defining a row of equally sized squares along the entire surface, said squares sized to receive said playing pieces;

said lumber pieces assembled together to form a game board having a playing surface with rows and columns of squares wherein the side surfaces of the lumber pieces, defining the different heights, being adjacent to one another, and the side surfaces of the lumber pieces, defining the widths, being placed face up to create the playing surface;

said playing surface having rows of different levels, wherein said first set of lumber pieces placed adjacent each other define innermost rows having a lowest level, said second set of lumber pieces placed on two opposite sides adjacent and outside of the first set of lumber pieces define second rows having a higher level than said innermost rows, said third set of lumber pieces placed on two opposite sides adjacent and outside of the second set of lumber pieces define third rows having a higher level than said second rows, and said fourth set of lumber pieces placed on two opposite sides adjacent and outside of the third set of lumber pieces define outermost rows having a highest level.

2. The board game of claim 1 further comprising a table having a top, said top having an open box structure comprising two interior shelves on opposite interior sides of the box for storing captured playing pieces, said box structure also having a recessed surface between the interior shelves for supporting the assembled game board, the side surfaces of the interior shelves provide lateral support for the lumber pieces.

3. The table of claim 2 further comprising a table height of 17.5" and two interior shelves 25" long and 3.5" wide.

4. The board game of claim 1, wherein the squares are non-colored, and are 1.5"×1.5" in size.

5. The board game of claim 1, wherein said game board comprises eight lumber pieces, each lumber piece having a length of 25.5" and a width of 1.5", resulting in a game board having 136 squares consisting of 17 columns of various height and 8 rows of constant height.

6. The board game of claim 1, wherein the demarcations are ¼" grooves.

7. The board game of claim 1 wherein the height of the first set of lumber pieces is 1.25", the height of the second set of lumber pieces is 2.25", the height of the third set of lumber pieces is 3.25" and the height of the fourth set of lumber pieces is 4".

8. The board game of claim 1, wherein said game board comprises seventeen lumber pieces, each lumber piece having a length of 12" and a width of 1.5", resulting in a game board having 136 squares consisting of 17 columns of constant height and 8 rows of various heights.

9. The board game of claim 1 wherein the height of the first set of lumber pieces is 1.5", the height of the second set of lumber pieces is 2.5", the height of the third set of lumber pieces is 3.5" and the height of the fourth set of lumber pieces is 4".

10. A four-player board game for playing chess or checkers comprising:

a plurality of playing pieces;

a solid one-piece game board formed from a plurality of lumber pieces attached together, said solid one-piece game board having a pyramidal shape with a four-sided square base, said game board having playing surfaces formed from said lumber pieces attached together to form a plurality of four-sided square shaped rings, each square shaped ring having a different side length, and each square shaped ring arranged concentrically to form a plurality of ringed steps of different vertical levels to create said pyramidal shape;

said game board having two playing surfaces on opposite sides of the game board comprising:

a first playing surface which steps upward from the outermost concentric ringed step, which is the lowest step, to the inner-most concentric ringed step which is the highest step at the center of the first playing surface;

and a second playing surface which steps downward from the outermost concentric ringed step, which is the highest step, to the innermost concentric ringed step which is the lowest step at the center of the second playing surface, wherein a particular playing surface is chosen for play by flipping over the pyramidal shape game board so that either the first playing surface or the second playing surface is positioned face-up;

said surface along each step is demarcated into squares, said squares are sized to receive said playing pieces.

11. The board game of claim 10, wherein the squares are non-colored, and are 1.5"×1.5" in size.

12. The board game of claim 10, wherein the demarcations are ¼" grooves.

13. The board game of claim 10, wherein each ringed step is made of four lumber pieces 1.5" wide, each lumber piece having a length corresponding to the length of one side of that particular ring, said game board having five ringed steps:

a first ringed step having lengths of 6"×6", and having 12 non-colored squares on one playing surface and 12 non-colored squares on the opposite playing surface;

a second ringed step having lengths of 9"×9", and having 20 non-colored squares on one playing surface and 20 non-colored squares on the opposite playing surface;

a third ringed step having lengths of 12"×12", and having 28 non-colored squares on one playing surface and 28 non-colored squares on the opposite playing surface;

a fourth ringed step having lengths of 15"×15", and having 36 non-colored squares on one playing surface and 36 non-colored squares on the opposite playing surface;

a fifth ringed step having lengths of 18"×18", and having 44 non-colored squares on one playing surface and 44 non-colored squares on the opposite playing surface.

14. The board game of claim 10, wherein the pyramidal top interior and exterior face are made from a lumber piece 3"×3" square having 4 non-colored squares on each of the interior face and the exterior face.

15. The board game of claim 10, wherein the total number of squares on the first playing surface is 144, and the total number of squares on the second playing surface is 144.

16. The board game of claim 10 further comprising a table having a top, said top having an open box structure comprising two interior shelves on opposite interior sides of the box for storing captured playing pieces, said box structure also having a recessed surface between the interior shelves, interior shelves and recessed surface between interior shelves support the pyramidal shape.

17. The table of claim 16 further comprising a table height of 17.5" and two interior shelves 25" long and 3.5" wide.

18. A board game of claim 10 further comprising a mounting ring in lieu of said table;

said mounting ring allows the pyramidal shape to sit on the top of the ring and whose interior slides over the outside of the mounting ring and a level rests upon the mounting ring or, when the pyramidal shape is flipped over, the exterior sides of the pyramidal shape slide within the interior sides of the mounting ring and a level rests upon the mounting ring;

said rectangular mounting ring has a height 5.5", width 12" at outside, length 12" at outside and a wall thickness of 1.5".

19. A four-player board game for playing chess or checkers comprising:

a plurality of playing pieces;

a plurality of elongated lumber pieces each having a length, and square cross-sectional area;

said lumber pieces assembled together to form a game board having a playing surface, wherein each lumber piece stands upright on its cross-sectional area, the top square cross-sectional area on each lumber piece defines a playing square on the playing surface, and sized to receive a playing piece, and the length of each lumber piece determines the height of the playing square;

said lumber pieces having different heights, wherein a first set of lumber pieces having a first height, a second set of lumber pieces having a second height which is greater than said first height, a third set of lumber pieces having a third height which is greater than said second height, and a fourth set of lumber pieces having a fourth height which is greater than said third height, and a fifth set of lumber pieces having a fifth height which is greater than said fourth height;

said playing surface consisting of 136 playing squares of different heights, and said playing squares arranged in rows and columns consisting of eight rows of various height variation and seventeen columns of various height variation and a base for supporting said game board.

20. The game board of claim 19 further comprising the quantity of said lumber pieces is 52 for the first height, 51 for the second height, 23 for the third height, 9 for the fourth height, and 1 for the fifth height.

21. The game board of claim 19 further comprising a base 12" wide, 25.5" long, and 0.25" thick that the lumbers stand upon.

22. The game board of claim 19 further comprising lumber pieces whose cross-section is 1.5"×1.5".

23. The game board of claim 19 further comprising lumber pieces whose various lengths are 1.5" for the first height, 3" for the second height, 4.5" for the third height, 6" for the fourth height, and 7.5" for the fifth height.

24. The board game of claim 19 further comprising a table having a top, said top having an open box structure comprising two interior shelves on opposite interior sides of the box for storing captured playing pieces, said box structure also having a recessed surface between the interior shelves for supporting the assembled game board, the side surfaces of the interior shelves provide lateral support for the lumber pieces.

25. The table of claim 24 further comprising a table height of 17.5" and two interior shelves 25" long and 3.5" wide.

* * * * *

UNITED STATES PATENT AND TRADEMARK OFFICE

CERTIFICATE OF CORRECTION

PATENT NO. : 6,279,907 B1 
DATED : August 28, 2001
INVENTOR(S) : Marvin Douglas Hullinger It is certified that error appears in the above-identified patent and that said Letters Patent is hereby corrected as shown below:

Drawings,
Substitute drawing sheets 1-8 and 10 for the attached drawing sheets 1-8 and 10.

Column 1,
Line 56, "players" should read -- player --.
Line 62, "Webpage" should read -- website --.

Column 2,
Line 16, "are" should read -- were --.

Column 5,
Lines 42-46, "Other materials could be used, I like the look and feel of wood. The following description of the prototypes includes reference to seventeen figures, or pictures (most of which are copies of photos of the prototypes) by including the figure number in the description." should read -- Other materials including plywood, cardboard, plastic, foam, and stone could be used to build Spacial Game Boards. --.

Column 6,
Lines 8-12, "All boards (25.5" in length) were ripcut from "2 by 4" wood, except the 4" height, which was cut from a "2 by 6". Four height variations (1.25" 2.25", 3.25", & 4") for eight boards were created (two of each height)" should read -- Eight playing surface lumbers with two lumbers conforming to each of the following four heights (1.5" 2.5", 3.5", & 4.5") --.
Line 18, "(A~1.25", B~2.25", C~3.25", & D~4")" should read -- (A~1.5", B~2.5", C~3.5", & D~4.5") --.
Line 35, "a top that is 22" deep and 28.5" wide" should read -- a top that is 22" wide and 28.5" long --.
Lines 45 and 46, "Twelve inch long boards were ripcut to form height variations of (1.5", 2.5", 3.5", & 4")" should read -- Seventeen playing surfaces lumbers were created with height variations of (1.5", 2.5", 3.5", & 4.5") --
Line 55, "4" ~d" should read -- 4.5" ~d --.

UNITED STATES PATENT AND TRADEMARK OFFICE

CERTIFICATE OF CORRECTION

PATENT NO. : 6,279,907 B1
DATED : August 28, 2001
INVENTOR(S) : Marvin Douglas Hullinger It is certified that error appears in the above-identified patent and that said Letters Patent is hereby corrected as shown below:

Column 9,
Line 8, "25" should read -- 25.5 --.
Line 19, "1.25" should read -- 1.5 --.
Line 20, "2.25" should read -- 2.5 --.
Line 21, "3.25" should read -- 3.5 --.
Line 22, "4" should read -- 4.5 --.
Line 32, "4" should read 4.5 --.

Column 10,
Line 38, "25" should read -- 25.5 --.

Column 12,
Lines 5 and 6, "3" for the second height, 4.5" for the third height, 6" for the fourth height, and 7.5" for the fifth height" should read -- "2.5" for the second height, 3.5" for the third height, 4.5" for the fourth height, and "5.5" for the fifth height --.
Last line, "25" should read -- 25.5 --.

Signed and Sealed this

Eighteenth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,279,907 B1
DATED : August 28, 2001
INVENTOR(S) : Marvin Douglas Hullinger It is certified that error appears in the above-identified patent and that said Letters Patent is hereby corrected as shown below:

The Title page showing the illustrative figure should be deleted and substitute therefore the attached title page.

The Drawing Sheets 1-8 and 10 should be deleted and substitute therefore the attached Drawing Sheets 1-8 and 10.

Columns 1-10 of the specification should be deleted and replace therefore with the corrected columns 1-10 of the specification as attached.

This certificate supersedes the Certificate of Correction issued June 18, 2002.

Signed and Sealed this

Fifteenth Day of April, 2003

JAMES E. ROGAN
*Director of the United States Patent and Trademark Office*

(12) United States Patent
Hullinger

(10) Patent No.: US 6,279,907 B1
(45) Date of Patent: Aug. 28, 2001

(54) SPACIAL GAME BOARD WITH SPACIAL CHESS AND SPACIAL CHECKERS

(76) Inventor: Marvin Douglas Hullinger, 14426 Beverly Park Rd. #2, Edmonds, WA (US) 98026

( * ) Notice: Subject to any disclaimer, the term of this patent is extended or adjusted under 35 U.S.C. 154(b) by 0 days.

(21) Appl. No.: 09/231,461

(22) Filed: Jan. 14, 1999

(51) Int. Cl.[7] ..... A63F 3/02

(52) U.S. Cl. ..... 273/241; 273/260; 273/261; 273/283; D21/336; D21/337; D21/348; D21/349

(58) Field of Search ..... 273/287, 236, 273/241, 260, 261, 283, 284; D21/336, 337, 348, 349

(56) References Cited

U.S. PATENT DOCUMENTS 4,099,723 * 7/1978 Robinson .
4,147,359 * 4/1979 King .
4,179,127 * 12/1979 Goodman .
4,696,476 * 9/1987 Eplett .
4,861,040 * 8/1989 Peterson .
5,112,056 * 5/1992 Ching .
5,358,252 * 10/1994 McPhaul .
5,456,472 * 10/1995 Goodman .
5,662,329 * 9/1997 Nason .

* cited by examiner

*Primary Examiner*—Benjamin H. Layno

(57) ABSTRACT

The Spacial Game Board is a two, four, or more player game board for playing Spacial Chess, Spacial Checkers, or other game based on Spacial Chess or Spacial Checkers comprising: a plurality of elongated lumber (or other material) pieces each having a length, a height and a width that define a three-dimensional playing surface; said surface along the width of each lumber piece has demarcations that define a row of equally sized squares or, said surface made from the top ends of lumber pieces define equally sized squares, said squares sized to receive playing pieces. Configurations of playing surfaces are made from the lumber pieces. Some configurations allow the movement of the lumber pieces at set up to vary the playing surface, other configurations are made from one assemblage of attached lumbers. Some configurations are set on a small table, the Spacial Game Board Table. The assemblage of attached lumber configurations can be placed over a mounting sleeve. The Spacial Game Board and Spacial Chess and Spacial Checkers are also computer generated so that they can be played via the computer.

25 Claims, 10 Drawing Sheets

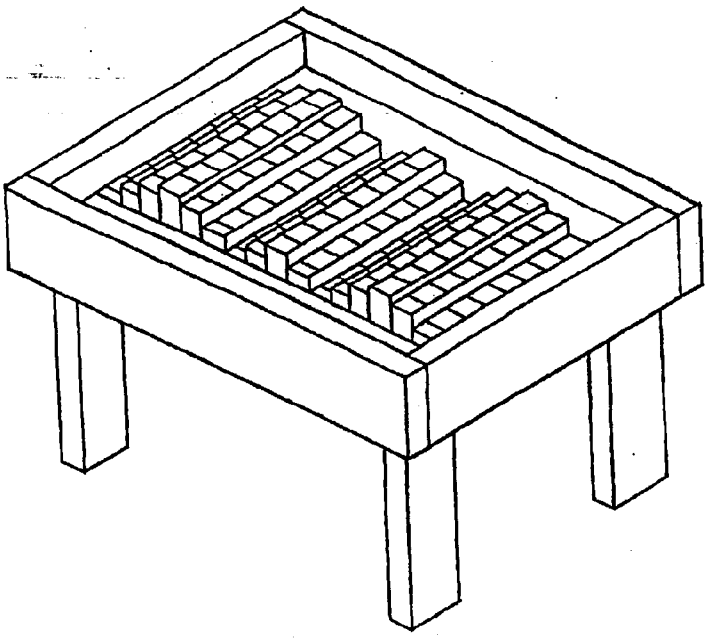

SPACIAL GAME BOARD WITH SPACIAL CHESS AND SPACIAL CHECKERS

CROSS REFERENCE TO RELATED APPLICATIONS

Chessboard, checker board; the game of Chess, the game of Checkers.

STATEMENT REGARDING FED SPONSORED R & D

There is no Fed sponsored R & D.

REFERENCE TO MICROFICHE APPENDIX

There is no reference to the Microfiche appendix.

BACKGROUND OF THE INVENTION

Having grown up playing chess, I recently wondered how to make the game more challenging. I thought about the flat game board, how to change it so that an additional challenge of spatiality could be incorporated. By adding contiguous height variations, the game pieces would not lie on one flat plane. Rather, they would lie on contiguous squares of varying heights. A variation of the word spatial is the word spacial. I named my creation the SPACIAL GAME BOARD.

The seating arrangement in a sports arena, where each row of seats is in ascending, contiguous levels of height is an example of the spatial game board "stair step" height variation.

I also wanted to create a way that two couples, or four people could play chess at the same time. This would entail the use of two sets of chess pieces, or four kingdoms. The FOUR KINGDOM SPACIAL GAME BOARD would need to be larger than the consolidation of two standard (64 square) game boards. The additional squares will provide some space between adjacent kingdoms at the beginning of the game.

Having more than four players playing at one time could be incorporated by adding more squares; 72 for each additional pair of players. I can envision a real-life large table with a game board of 352 squares (on various contiguous levels) and ten players enjoying a "long-play-time" game. I can also envision ten players playing the same game board but each player is in their own home and is connected to a Spacial Chess and Spacial Checkers Website, playing via the computer.

Being a wood worker, I felt that the spacial game board prototypes should be made of wood. By setting various lengths of "2 by 4, 2 by 6, & 2 by 8" wood boards on their small side and, attaching them about a "2 by 4" cut to 3.5" length (laid flat on the large side), I created an ascending "stair step", or step of 1.5". The result is a box like structure with stair steps descending toward the middle from each side. I marked each board with a line every 1.5" down the length of the sides to form squares. This game board has a total of sixty-four squares, each (1.5"×1.5"). The exterior of the game board is (12"×12"). This game board was so challenging that diagonal lines had to be drawn to aid in the discernment of the correct diagonal squares for a piece to move along.

The following spacial game board versions are made of wood and finished to produce "furniture quality" pieces. All squares were formed by hand sawing (0.25") deep cuts on the small side (1.5") of each "2 by board" in 1.5" intervals.

The second prototype was the Four Kingdom Spacial Game Board. This game board was made with eight wood boards of various heights when laid on their small side. All boards (25.5" in length) were rip-cut from "2 by 4" wood, except the 4" height, which was cut from a "2 by 6". Four height variations (1.25", 2.25", 3.25", & 4") for eight boards were created (two of each height). I cut (0.25") deep lines into the topside of the boards with a handsaw. Seventeen "squares" were formed on each board as a result of the lines. This game board has a total of 136 squares (1.5"×1.5") formed by eight rows (of various height) of seventeen columns. If one were to make a letter association for each height (A~1.25", B~2.25", C~3.25", & D~4") and one were to look along the short side of the spacial game board table, one would see (as one example) the following height variation: DCBAABCD. Each of the eight boards can be placed in any row location so one can change the location of the various heights. For example:

DBACCABD. I had named some of the variations in the disclosure document for this type of game board as Four Kingdom 4 Level Spacial Game Board with Valley elevation layout and with Multiple Hill elevation layout. I now call this game board configuration the FOUR KINGDOM OPEN PLAIN SPACIAL GAME BOARD.

The SPACIAL GAME BOARD TABLE is a four-legged table whose top is a box-like structure that holds the boards that form the Spacial Game Board and provides shelf space for captured pieces. The table is 17.5" tall with a top that is 22" deep and 28.5" wide. There are two shelves that lie within the top box-like structure that are 25.5" long and 3.5" wide. The wood boards that form the Spacial Game Board sit between the two shelves and are held up by additional wood pieces that form the lower structure of the game board table. All configurations of the Four Kingdom Spacial Game Board can be placed in the Spacial Game Board Table.

The third prototype was made with made with seventeen boards, each with eight "squares". Twelve-inch long boards were rip-cut to form height variations of (1.5", 2.5", 3.5", & 4"). The 136 squares (1.5"×1.5") are formed from eight rows with seventeen columns (various height), The result is four levels where there are two highest levels, five second highest, six third highest, and four the fourth highest. The boards can be placed anywhere on the game table so as to change the location of a certain level. The standard layout is to have three hills formed by the various levels so that two high hills are on either side of a smaller hill. If one were to assign a letter to each height variation (1.5"~a, 2.5"~b, 3.5"~c, 4"~d) and to view the height variation along the long side of the spacial game board table; you would see: abcdcbabcbabcdcba. This game board lies on the spacial game board table. I called this version in the disclosure statement the Four Kingdom 4 Level 3 Mountain Transverse elevation layout. I now call this configuration the FOUR KINGDOM THREE HILL SPACIAL GAME BOARD.

The fourth prototype game board incorporated "2 by 4" wood boards. The center piece(2 by 4) cut to 3.5" in length is similar to the first prototype. The steps ascending from the center(arena configuration) were made with only one size of wood, the "2 by 4". The first step is 2" tall. Each following step is 1.5" tall. This prototype also created, when turned upside down(mountain configuration), a top center with descending steps.

Sawing lines every 1.5" along the step's top side formed squares. No diagonal lines were drawn. A total of sixty-four squares(1.5"×1.5") were formed. This piece is 12" wide by 12" deep with a height of 8".

A sleeve made of "2 by 4" wood holds the game board in place. The sleeve is (9"×9"×3.5"). In the Arena configuration the center slides through the sleeve and the "stair step" rests on it's top. The total height of the game board as mounted on the sleeve in the arena configuration is 8.5". In the mountain configuration, the game board rests on the sleeve. The resultant total height (mountain configuration) is 10". I call this configuration the TWO KINGDOM ARENA/MOUNTAIN SPACIAL GAME BOARD.

The fifth prototype is a Four Kingdom configuration. This prototype forms a pyramidal shape made from a plurality of four-sided square shaped rings. Rather than a center with three steps, this game board has five steps, each 1.5" tall. The resultant game board has 144 squares(1.5"×1.5"). This piece is 18" wide by 18" deep and is 9.5" tall.

The sleeve that holds this game board is made of (2 by 6) board. The sleeve is (12"×12"×5.5"). The game board, in the arena configuration mounted on the sleeve is 12" tall.

The game board can be turned upside down to form the mountain configuration. In this configuration, mounted on the sleeve, the total height is 12". This game board in the arena configuration, or the mountain configuration can also be placed in the Spacial Game Board Table

BRIEF SUMMARY OF THE INVENTION

Spacial Game Board is a contiguous stepped multi-level game board made from wood or, other material as well as computer generated for the use of playing Spacial Chess, Spacial Checkers, or other games based on Spacial Chess or Spacial Checkers with two, four, or more players.

The Spacial Game Board creates a challenging game board by incorporating spatiality to that which was traditionally a flat(two-dimensional) game board. The multiple levels are contiguous in that if one were to view the game board in a vertical axis centered on the game board, he would only see a number of squares, as though they were on a flat game board. It is when a person views the spacial game board from a player's view that the spatiality becomes apparent since he sees various height levels of squares.

Two Kingdom Spacial Chess, Two Kingdom Spacial Checkers, and Four Kingdom Spacial Checkers, currently, do not have any special rules in addition to the rules for the common chess and checkers games. Four Kingdom Chess has additional rules to common chess; one of which allows a kingdom in checkmate to remain "alive" for one round (every player taking one turn) in hope that another player will capture the piece that put this player in checkmate. If the piece is taken, the checkmated player continues to play the game. If not, the checkmated player removes all of his pieces from the game board and the remaining players continue to play.

The Spacial Game Board can be real-life hardware and it can be a computer generated game board in cyberspace. The bit board(Boolean representation) will be of a size sufficient to represent the various quantities of squares.

BRIEF DESCRIPTION OF THE DRAWINGS

A.

B.

C.

D.

E.

F.

G.

H.

I.

J.

DETAILED DESCRIPTION

Figure 1:
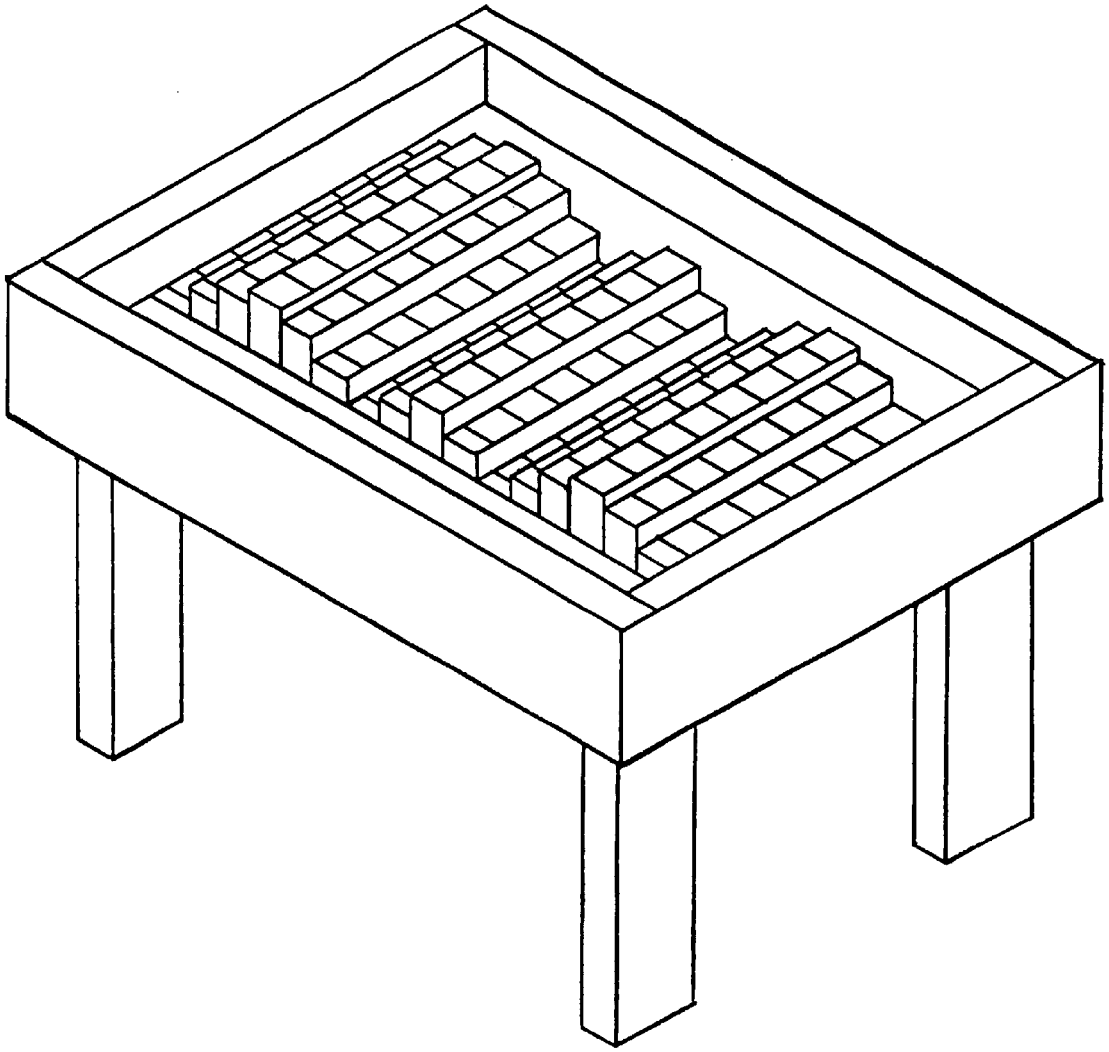
FIG. 1: Four Kingdom Three Hill Spacial Game Board configuration mounted on the Spacial Game Board Table.

The Spacial Game Board is a two, four, or more player game board for playing Spacial Chess, Spacial Checkers, or other game based on Spacial Chess or Spacial Checkers comprising: a plurality of elongated lumber (or other material) pieces each having a length, a height and a width that define a three-dimensional playing surface; said surface along the width of each lumber piece has demarcations that define a row of equally sized squares or, said surface made from the top ends of lumber pieces define equally sized squares, said squares sized to receive playing pieces. Configurations of playing surfaces are made from the lumber pieces, some configurations allow the movement of the lumber pieces at set up to vary the playing surface, other configurations are made from one assemblage of attached lumbers. Some configurations are set on a small table, the Spacial Game Board Table. The assemblage of attached lumber configurations can be placed over a mounting sleeve.

The Spacial Game Board is also computer generated so that one can access the game and play Spacial Chess, Spacial Checkers, or other game based on Spacial Chess or Spacial Checkers via the computer.

The Spacial Game Board creates a challenging game board by incorporating spatiality to that which was traditionally a flat (two-dimensional) game board. The multiple levels are contiguous in that if one were to view the game board in a vertical axis centered on the game board, he would only see a number of squares, as though they were on a flat game board. It is when a person views the Spacial Game Board from a player's view that the spatiality becomes apparent since he sees various levels of squares.

Multiples of greater than four players can be played on larger game boards than those of the prototypes. These game boards could be constructed using multiples of the prototype game board configurations in real life or, by computer generated game board configurations.

Two Kingdom Spacial Chess, Two Kingdom Spacial Checkers, and Four Kingdom Spacial Checkers, currently, do not have any special rules in addition to the rules for the common chess and checkers games. Four Kingdom, and Multiple (greater than four) Kingdom Chess have additional rules relative to common chess, one of which allows a kingdom in checkmate to remain "alive" for one round (every player taking one turn) in hope that another player will capture the piece that put this player in checkmate. If the piece is taken, the checkmated player continues to play the game. If not, the checkmated player removes all of his pieces from the game board and the remaining players continue to play.

The Spacial Game Board is real-life hardware and is also a computer generated game board. The computer generated bit board (Boolean representation) is of a size sufficient to represent the various quantities of squares. A website on the Internet is being created, where the Spacial Game Board configurations can be accessed and users play against the computer or other users for Two Kingdom, Four Kingdom, or Multiple Kingdom Spacial Chess, Spacial Checkers, or other games based on Spacial Chess or Spacial Checkers.

The computer software for the Spacial Chess and Spacial Checkers requires various bit board sizes. The bit board size required for each type of two, four, or multiple kingdom games matches the quantity of squares of the game board. This bit board is a Boolean representation of the game board. A two-kingdom bit board is a 64-bit word. A four-kingdom bit board, depending on the type of game board is a 136-bit word, or a 144-bit word. A multiple kingdom bit board for six players is a 208 (136+72)-bit word, or a 216 (144+72)-bit word. A ten player multiple kingdom bit board is a 352 [136+(3)72]-bit word, or a 360[144+(3)72]-bit word.

There are many kinds of bit-boards, one to represent the initial position of all the pieces at the beginning of the game, one of the initial position of each kingdom's pieces, one of each type of piece (rook, knight, queen, etc.), and many more including rotated bit boards (or attack boards). Operations performed on bit-boards include "and" (both bits set), "or" (one or both bits set), and "nor" (only one bit set, not both).

Spacial Chess and Spacial Checkers software follows a tree search methodology. By creating search functions the computer can choose the "best" move in a given situation. This allows users to play against the computer.

The Spacial Game Board prototypes are made of wood. Other materials for the construction of Spacial Game Boards include plywood, cardboard, plastic, foam, and stone.

The following spacial game board versions were made with clear Douglas fir wood and with good woodworking shop tools to produce "furniture quality" pieces. All squares are formed by hand sawing (0.25") deep cuts on the small side (1.5") of each "2 by board" in 1.5" intervals.

Figure 7:
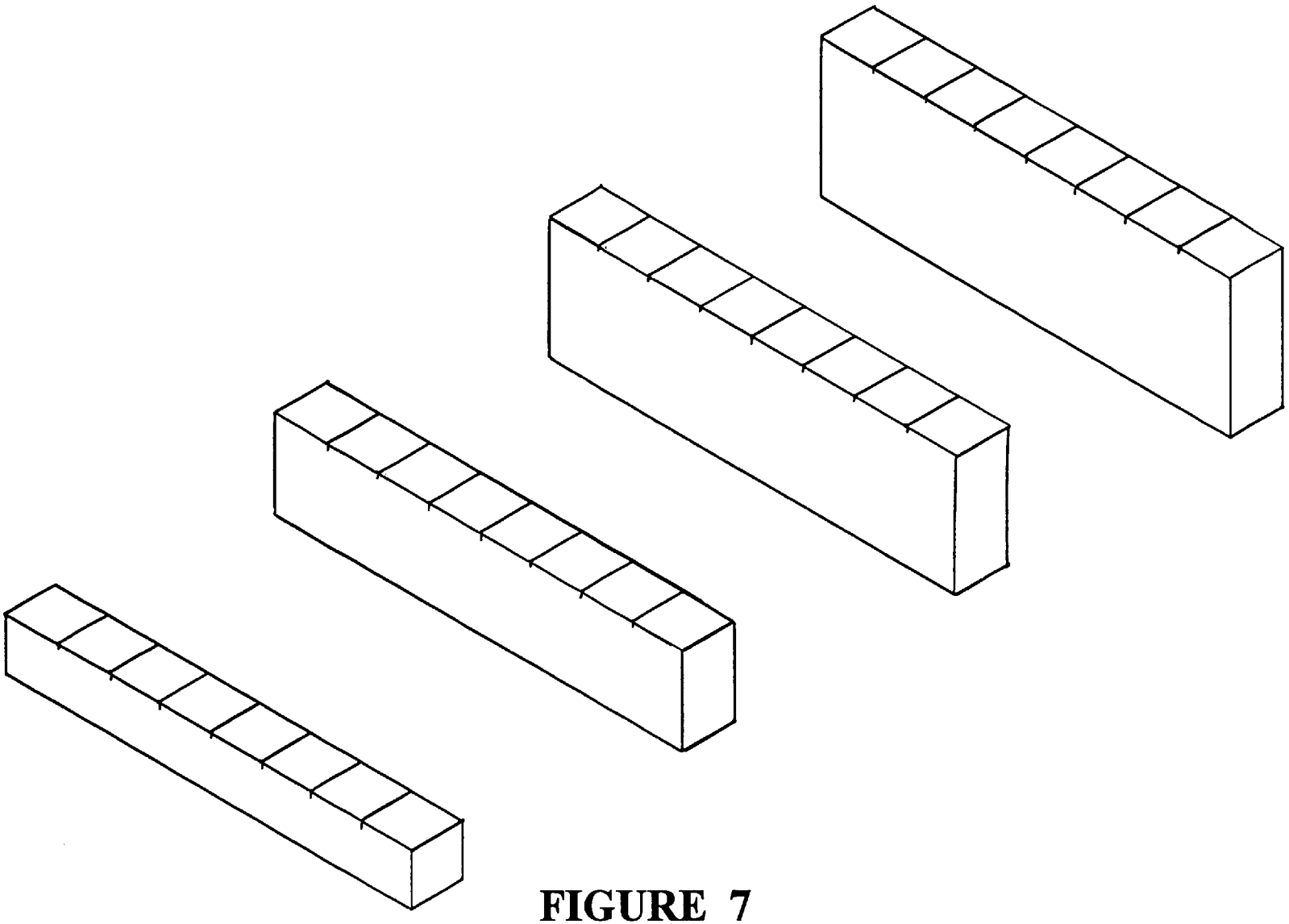
FIG. 7: Four Kingdom Three Hill Spacial Game Board configuration surface generation lumbers.

The FOUR KINGDOM THREE HILL SPACIAL GAME BOARD CONFIGURATION (FIG. 1) uses seventeen, twelve-inch long-playing surface lumbers (boards) that conform to the following four level heights (1.5", 2.5", 3.5", & 4.5"). One-quarter inch deep lines were cut into the topside of each lumber with a hand saw. Eight "squares" were formed on each board as a result of the lines. The 136 squares (1.5"×1.5") that comprise the playing surface are formed from eight rows with seventeen columns. Each column is a twelve-inch lumber (FIG. 7). The result is four levels (columns) where there are two highest levels, five second highest, six third highest, and four the fourth highest. The lumbers can be placed anywhere on the game table so as to change the location of a certain level. The standard layout is to have three hills formed by the various levels so that two high hills are on either side of a smaller hill. If one were to assign a letter to each height variation(1.5"~a, 2.5"~b, 3.5"~c, 4.5"~d) and to view the height variation along the long side of the Spacial Game Board Table; you would see: abcdcbabcbabcdcba This game board configuration mounts on the Spacial Game Board Table.

Figure 2:
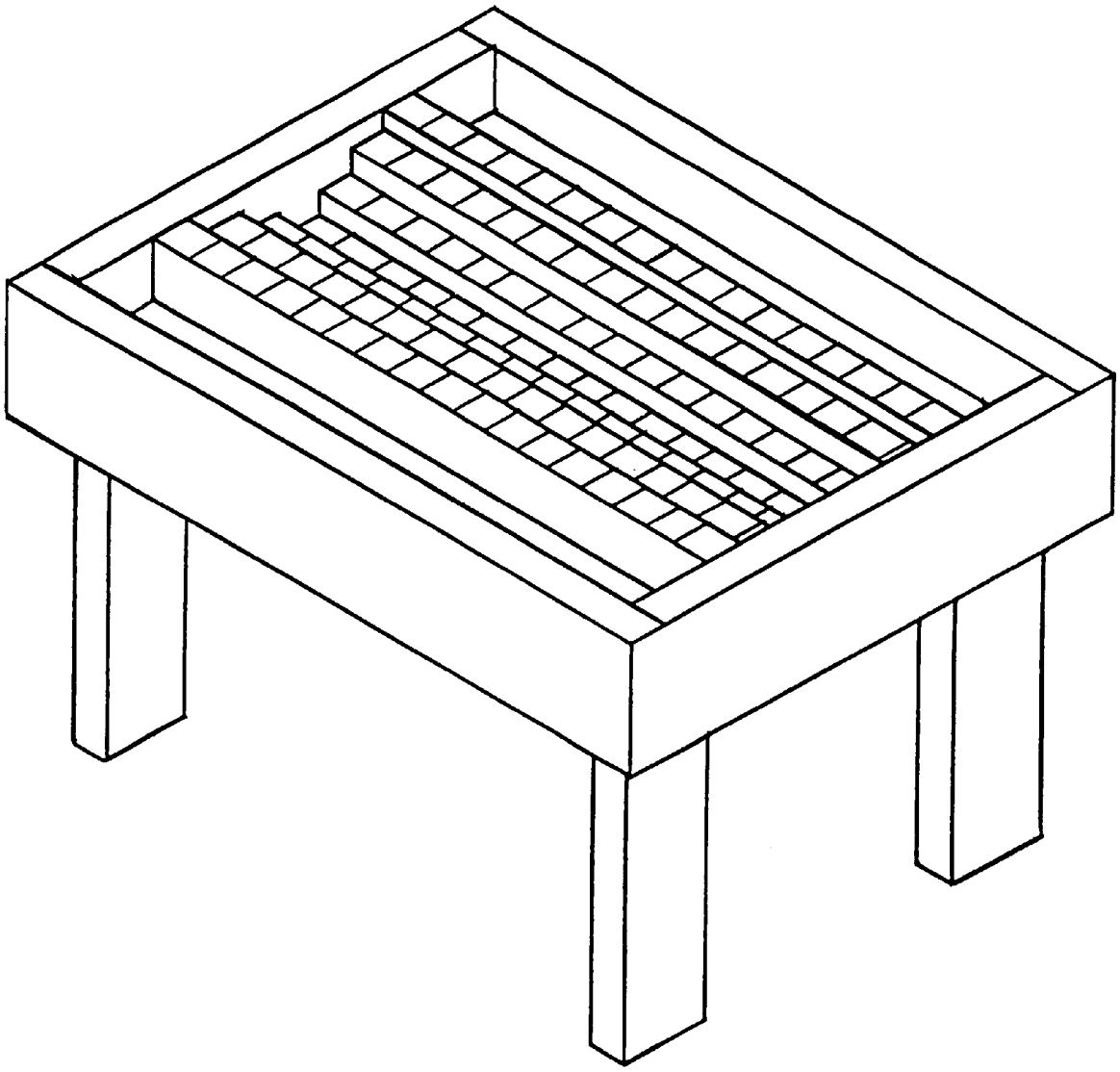
FIG. 2: Four Kingdom Open Plain Spacial Game Board configuration mounted on the Spacial Game Board Table.
Figure 8:
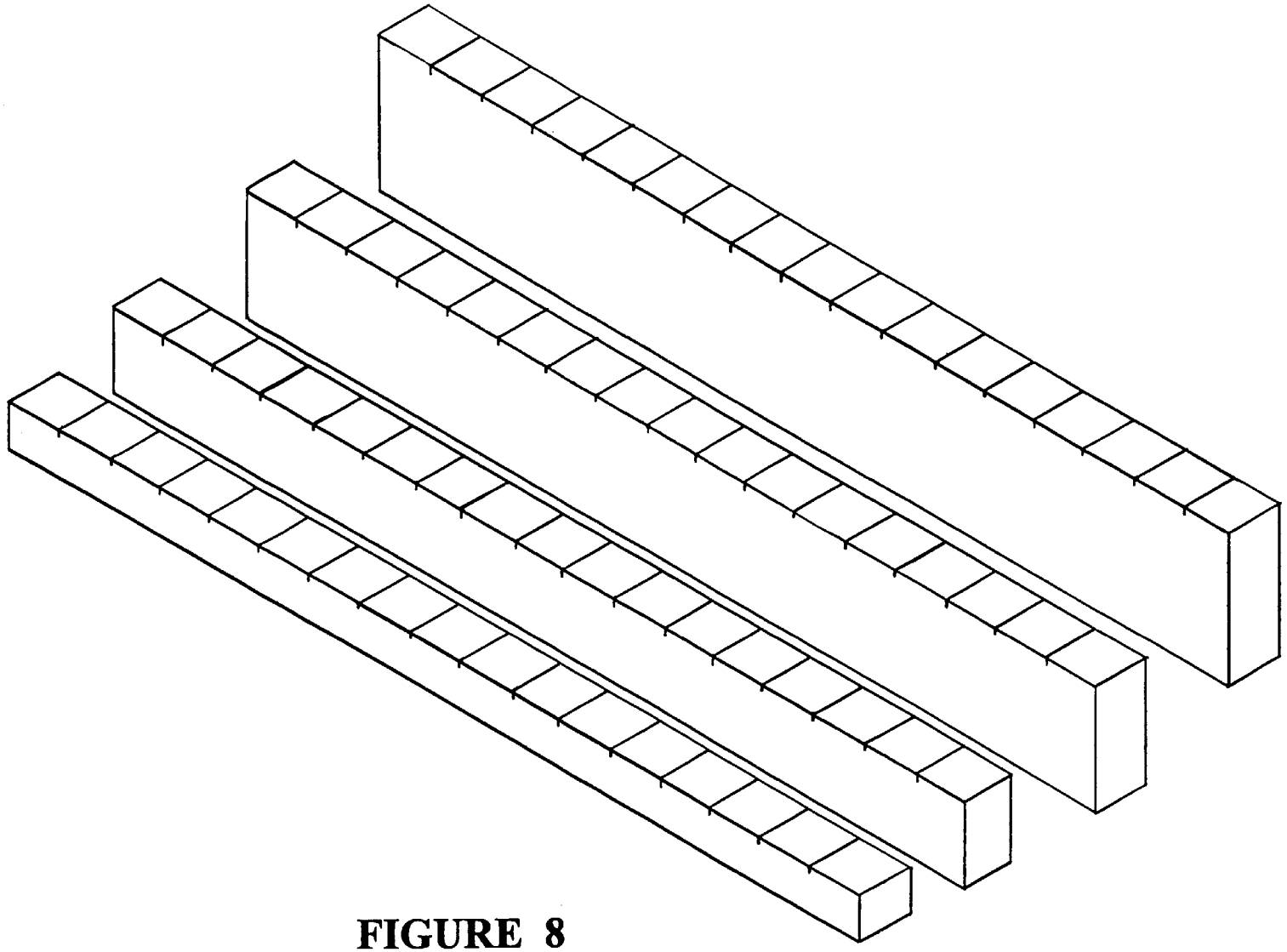
FIG. 8: Four Kingdom Open Plain Spacial Game Board configuration surface generation lumbers.

The FOUR KINGDOM OPEN PLAIN SPACIAL GAME BOARD CONFIGURATION (FIG. 2) is made with eight playing surface lumbers with two lumbers conforming to each of the following four heights (1.5", 2.5", 3.5", 4.5"). All lumbers (25.5" in length) were rip-cut from "2 by 4" wood, except the 4.5" height, which was cut from a "2 by 6". One-quarter inch deep lines were cut into the topside of each lumber with a hand saw. Seventeen "squares" were formed on each lumber (FIG. 8) as a result of the lines. This game board configuration has a total of 136 squares (1.5"×1.5") formed by eight rows (lumbers) and seventeen columns. If one were to make a letter association for each height (A~1.25", B~2.25", C~3.25", & D~4.5") and one were to look along the short side of the Spacial Game Board Table, one would see (as one example) the following height variation: DCBAABCD. Each of the eight lumbers can be placed in any row location so one can change the location of the various heights. For example; DBACCABD.

Figure 3:
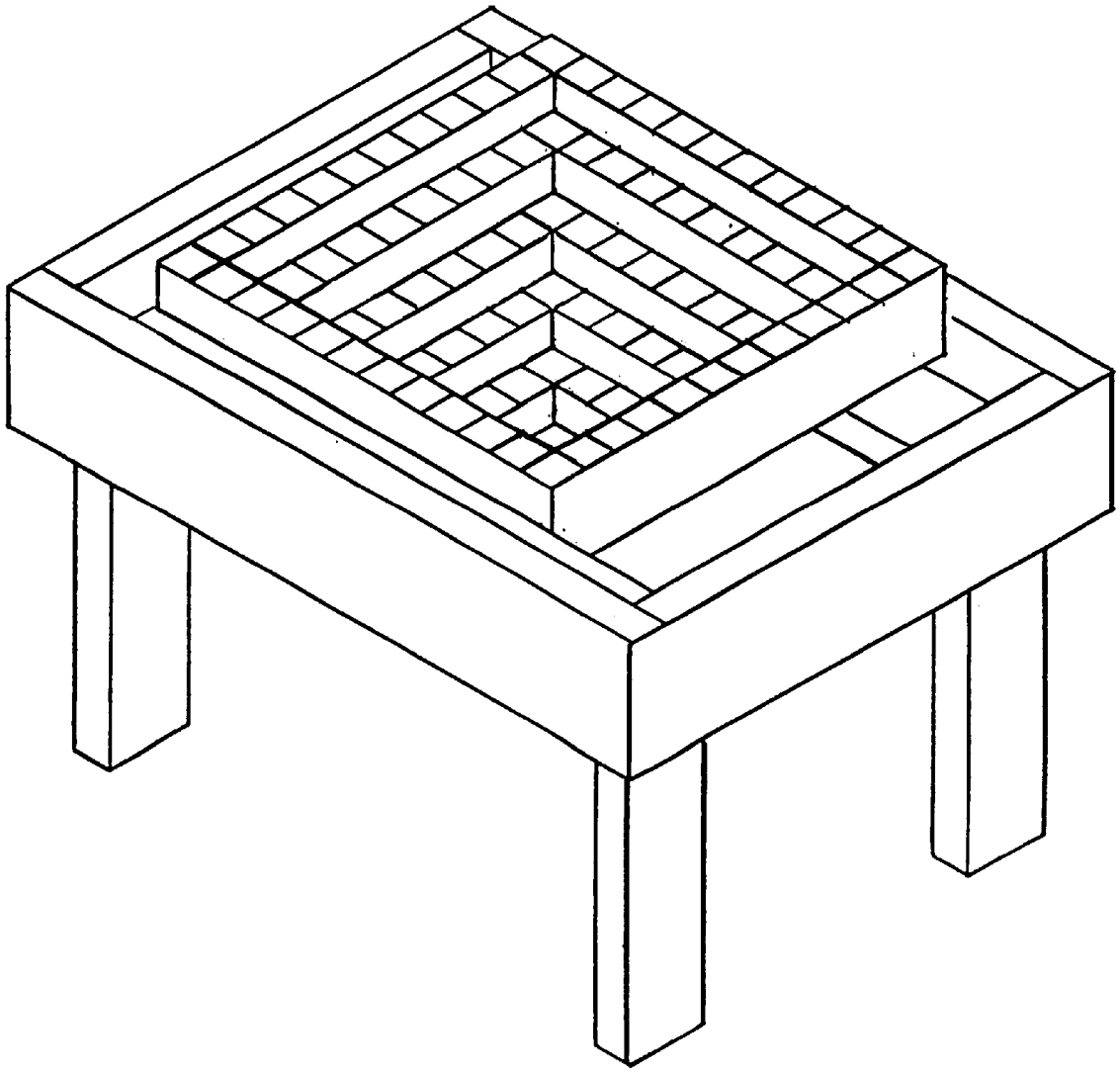
FIG. 3: Four Kingdom Arena/Mountain Spacial Game Board in the Arena configuration mounted on the Spacial Game Board Table.
Figure 4:
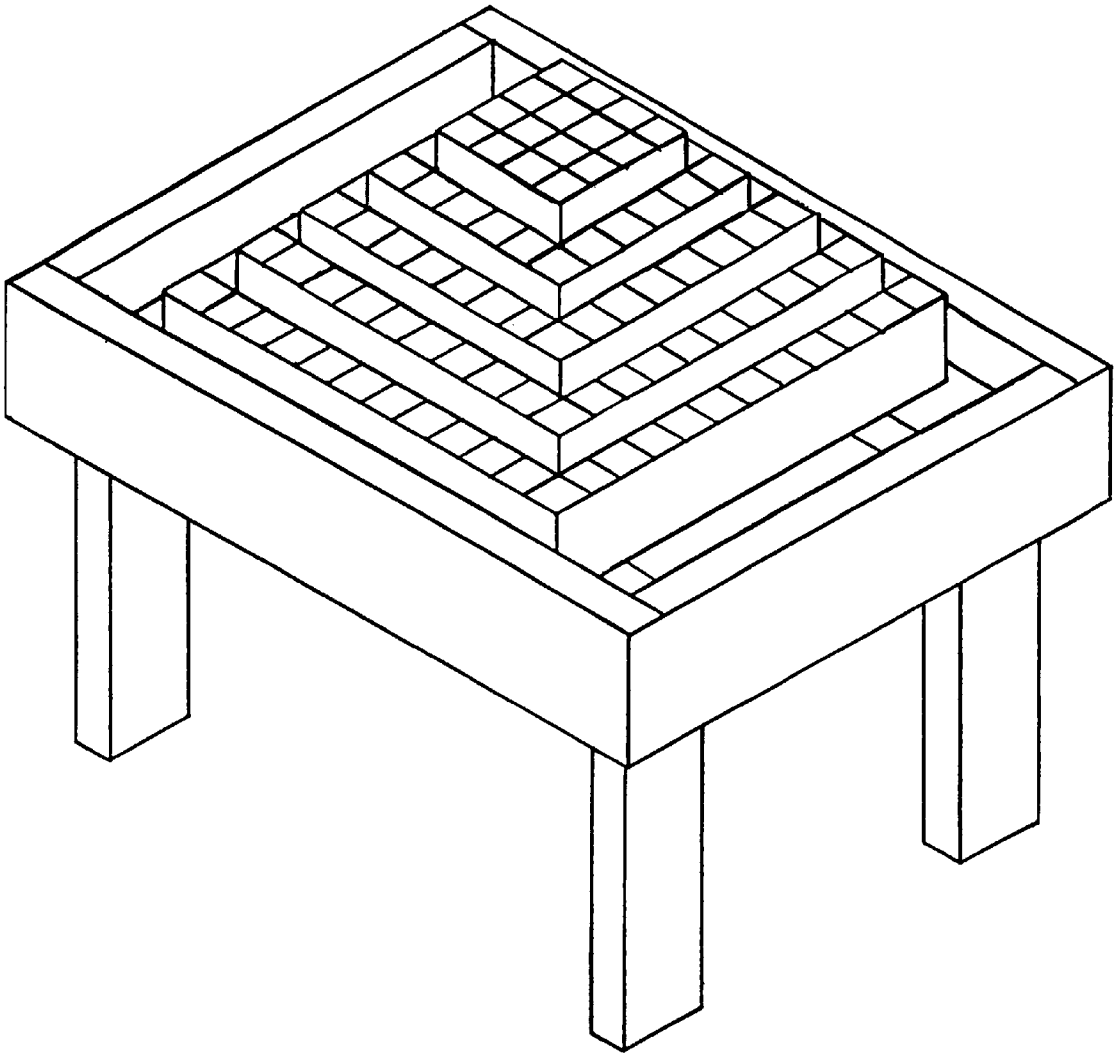
FIG. 4: Four Kingdom Arena/Mountain Spacial Game Board in the Mountain configuration mounted on the Spacial Game Board Table.
Figure 9:
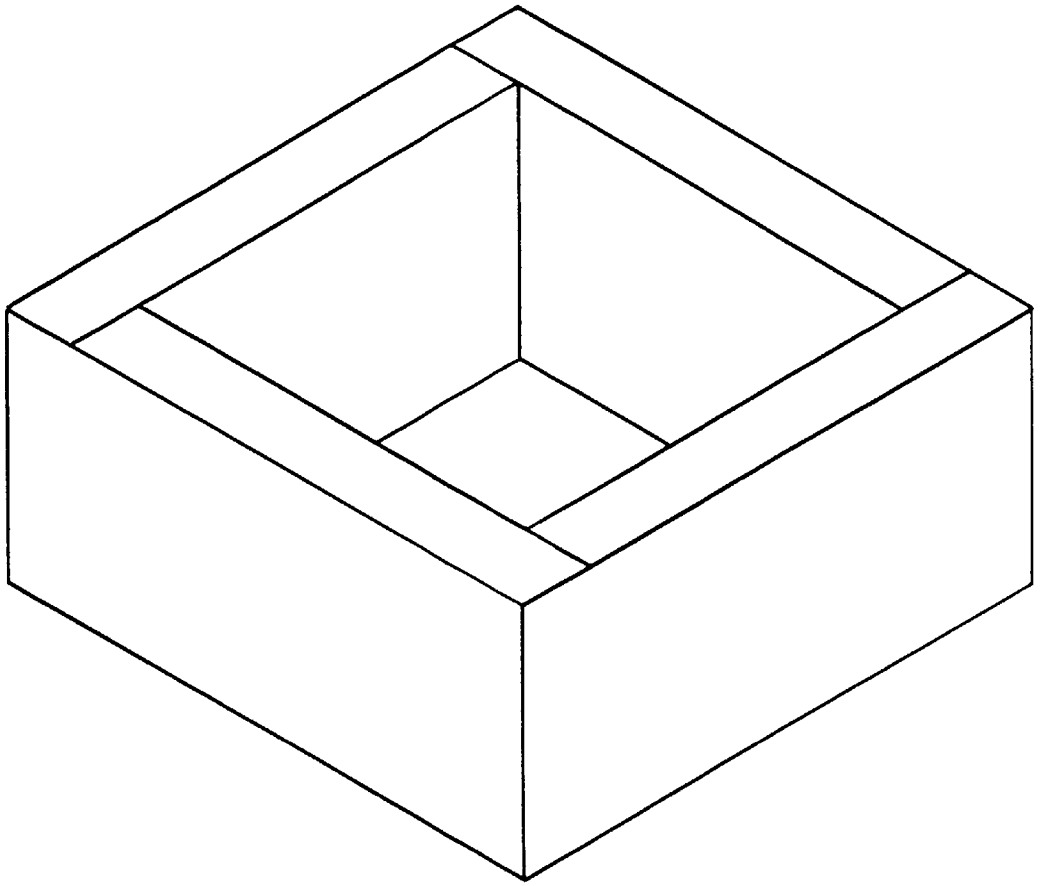
FIG. 9: Sleeve that the Four Kingdom Arena/Mountain configuration or sleeve that the Two Kingdom Arena/Mountain configuration (sleeve is smaller in size) mounts onto for playing without the use of the Spacial Game Board Table.

The FOUR KINGDOM ARENA/MOUNTAIN SPACIAL GAME BOARD CONFIGURATION; Arena Configuration (FIG. 3) uses a center piece (four squares made from a "2 by 4" cut to 3"×3") with five steps, each step is 1.5" tall made from "2 by 4" lumber. Squares were formed by sawing lines every 1.5" along each step's topside and bottom-side (for the Mountain configuration). The resultant game board has 144 squares (1.5"×1.5"). This piece is 18" wide by 18" deep and is 9.5" tall. The sleeve (FIG. 9) that this configuration can be mounted to in lieu of the Spacial Game Board Table is made of (2 by 6) board. The sleeve is (12"×12"×5.5"). The game board can be turned upside down to form the Mountain Configuration (FIG. 4) that has sixteen squares, which form the top level. A variation of the Four Kingdom Arena/Mountain Spacial Game Board is one that has only four squares that form the top level when in the Mountain configuration rather than sixteen.

The TWO KINGDOM ARENA/MOUNTAIN SPACIAL GAME BOARD CONFIGURATION uses a center piece (four squares made from a "2 by 4" cut to 3"×3"). The steps that ascended from the center and formed the Arena Configuration were made with "2 by 4" lumber. Each step is 1.5" tall. This prototype, when turned upside down forms the Mountain Configuration; a top center with descending steps. Squares were formed by sawing lines every 1.5" along each step's topside and bottom-side (creates squares for the Mountain configuration). A total of sixty-four squares (1.5"×1.5") were formed. This piece is 12" wide by 12" deep with a height of 8". A sleeve, similar to the one in FIG. 9, made of "2 by 4" wood is the structure that this configuration is mounted to. The sleeve is (9"×9"×3.5"). In the Arena configuration the center slides through the sleeve and the "stair step" rests on it's top. In the Mountain configuration the configuration slides over the sleeve and rests upon it.

The SPACIAL GAME BOARD TABLE (FIG. 6) is a four-legged table whose top is a box-like structure that holds the lumbers that form the Spacial Game Board and provides shelf space for captured pieces. The table is 17.5" tall with a top that is 22" wide and 28.5" long. There are two shelves that lie within the top box-like structure that are 25.5" long and 3.5" wide. The wood boards that form the Spacial Game Board sit between the two shelves and are held up by additional wood pieces that form the lower structure of the game board table. All versions of the Four Kingdom Spacial Game Board can be placed in the Spacial Game Board Table.

Figure 5:
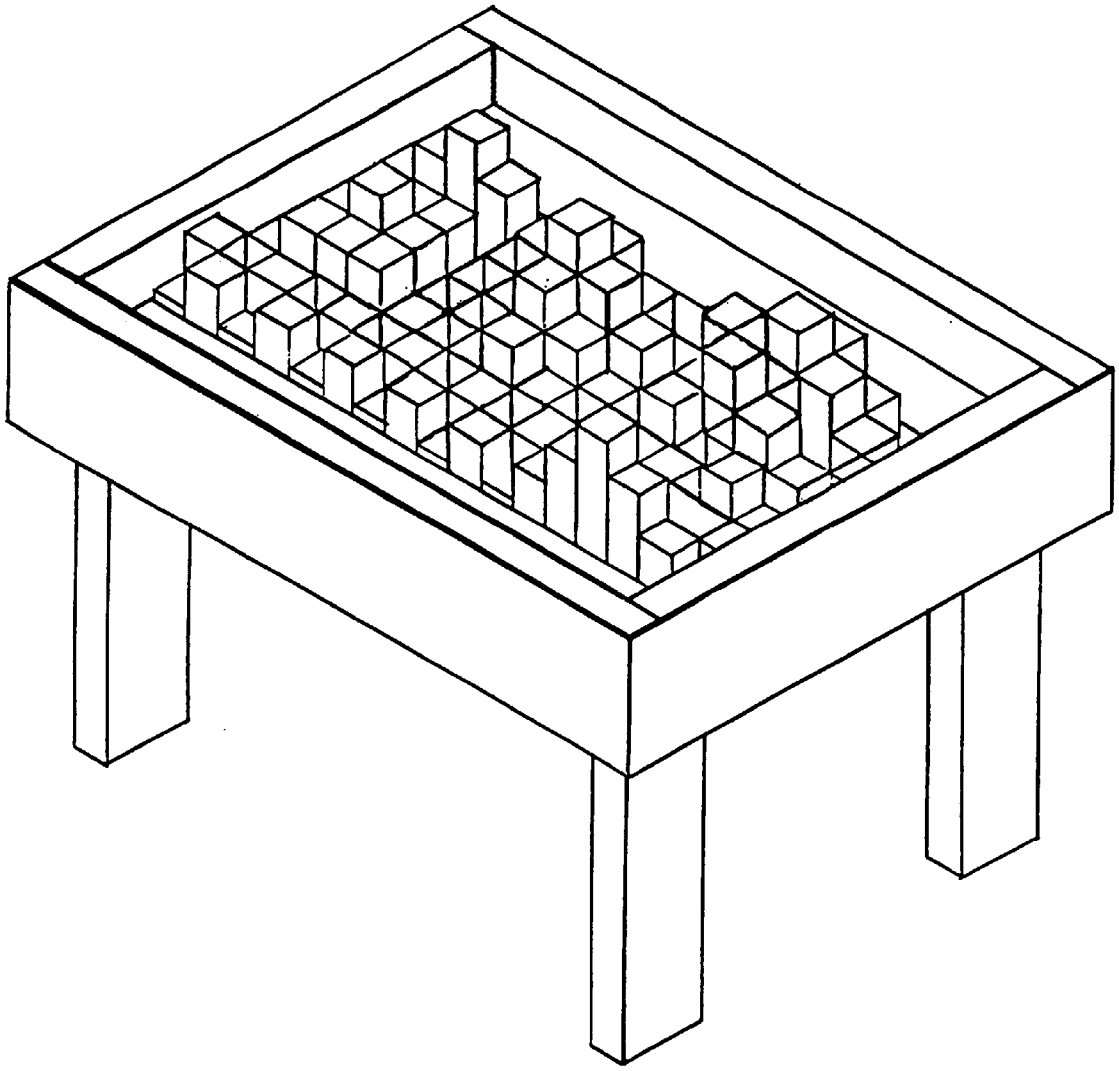
FIG. 5: Four Kingdom All Terrain Spacial Game Board mounted on the Spacial Game Board Table.
Figure 6:
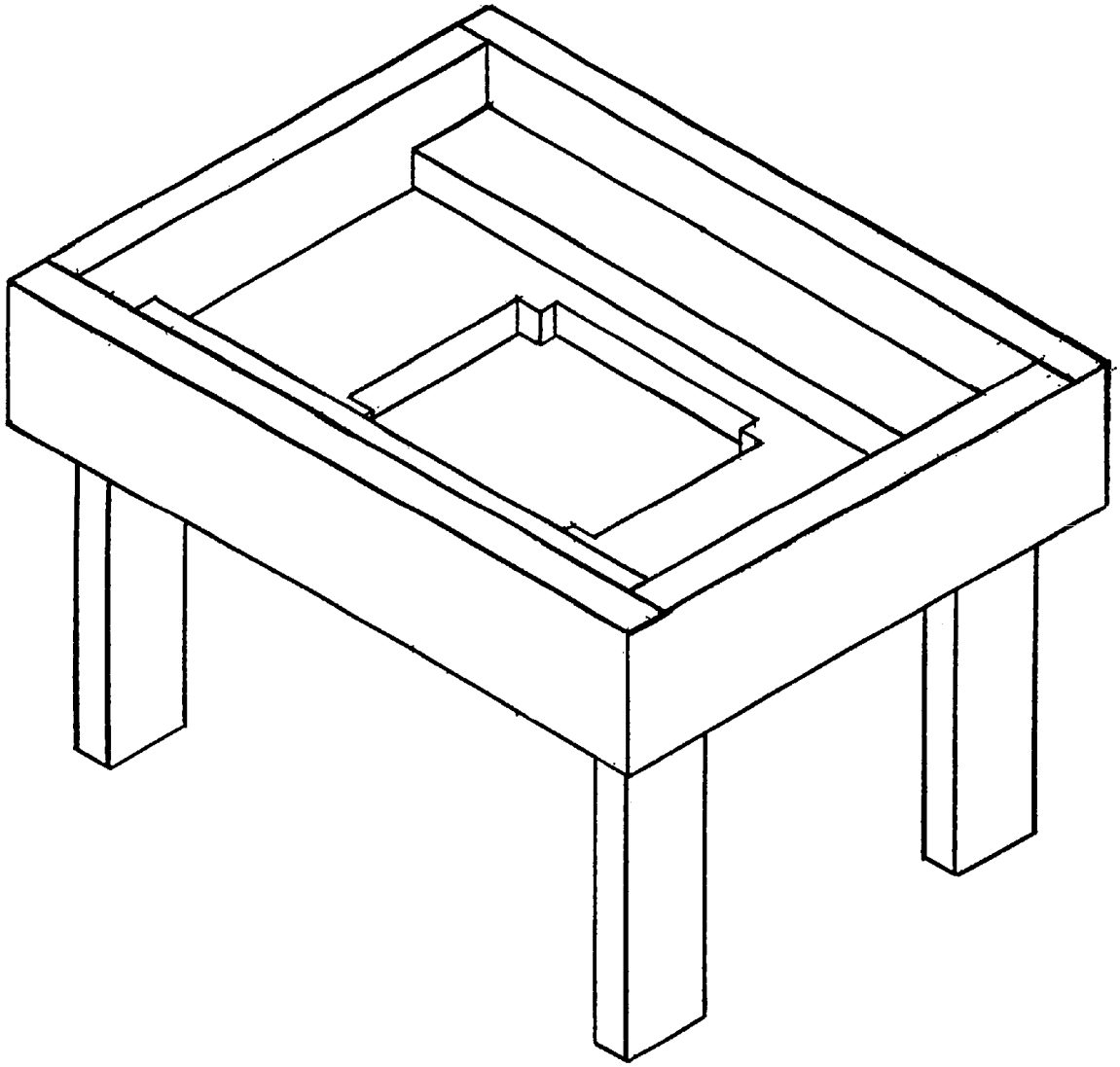
FIG. 6: Spacial Game Board Table
Figure 10:
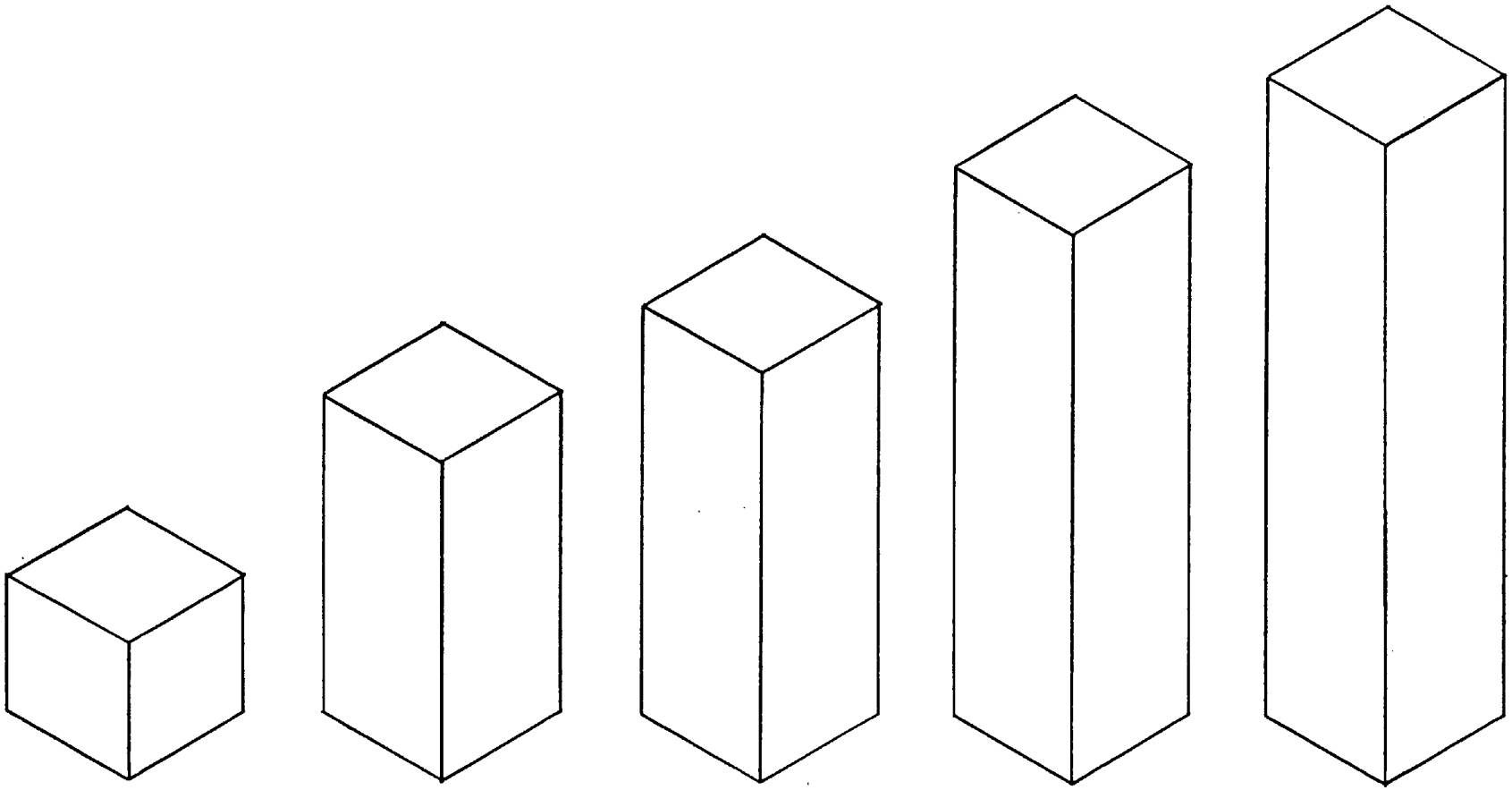
FIG. 10: Four Kingdom All Terrain Spacial Game Board configuration surface generation lumbers.
Figure 1:
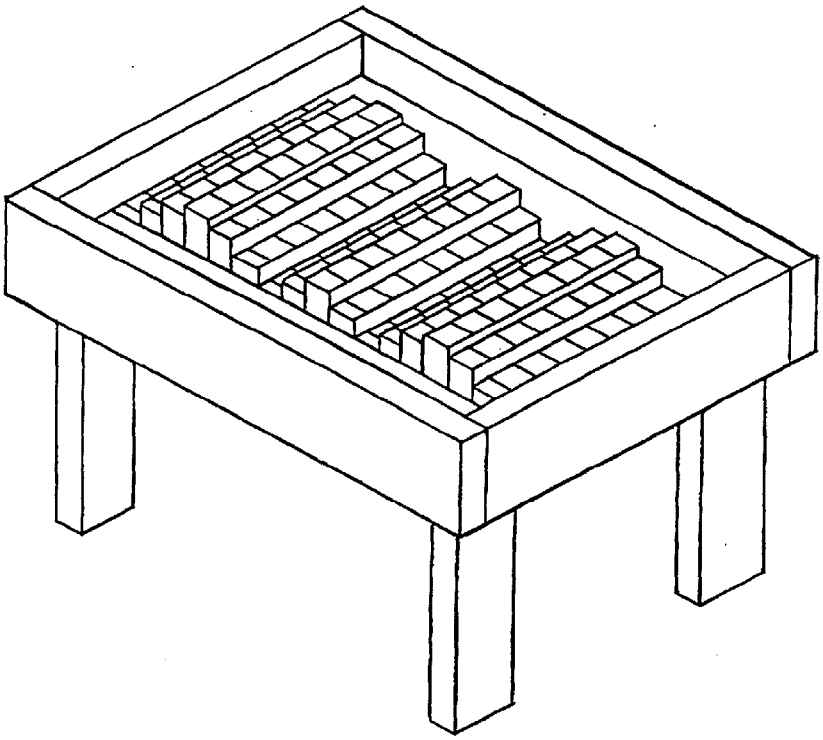
Figure 2:
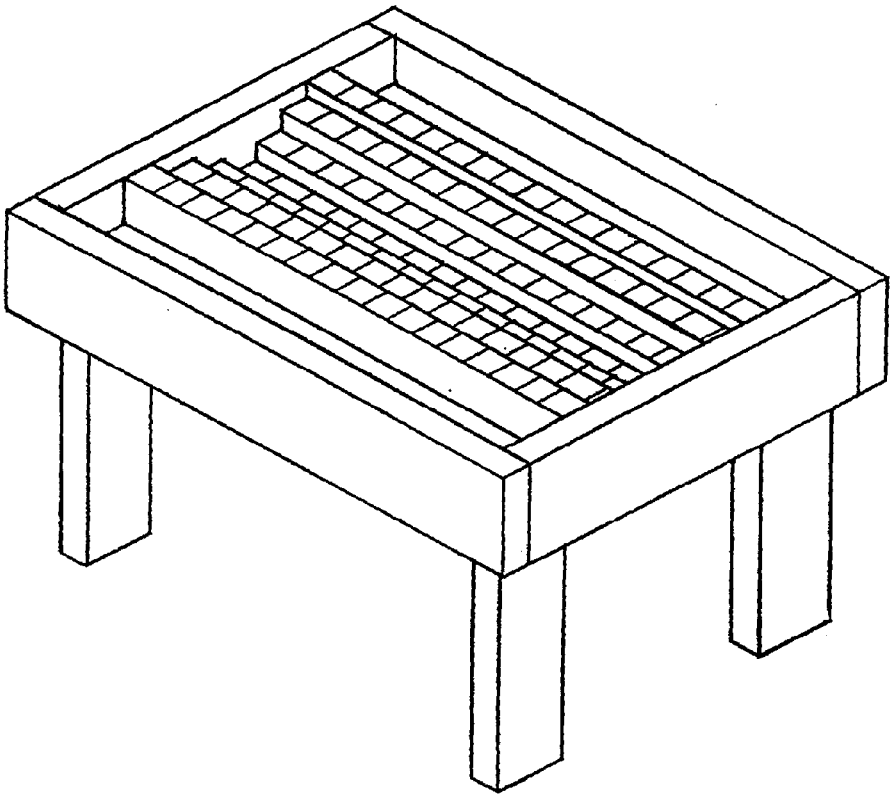
Figure 3:
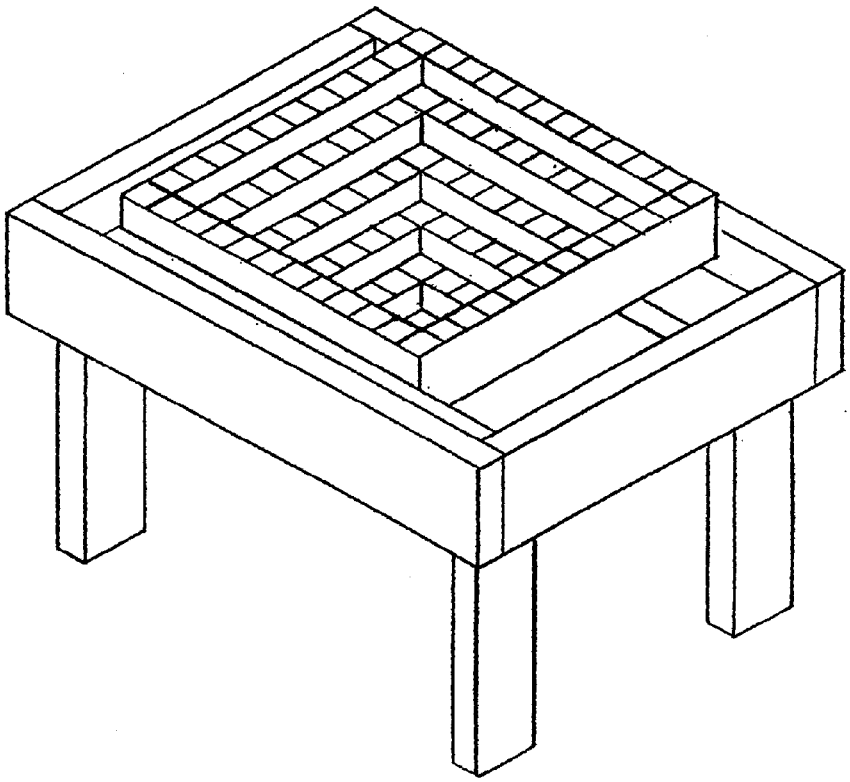
Figure 4:
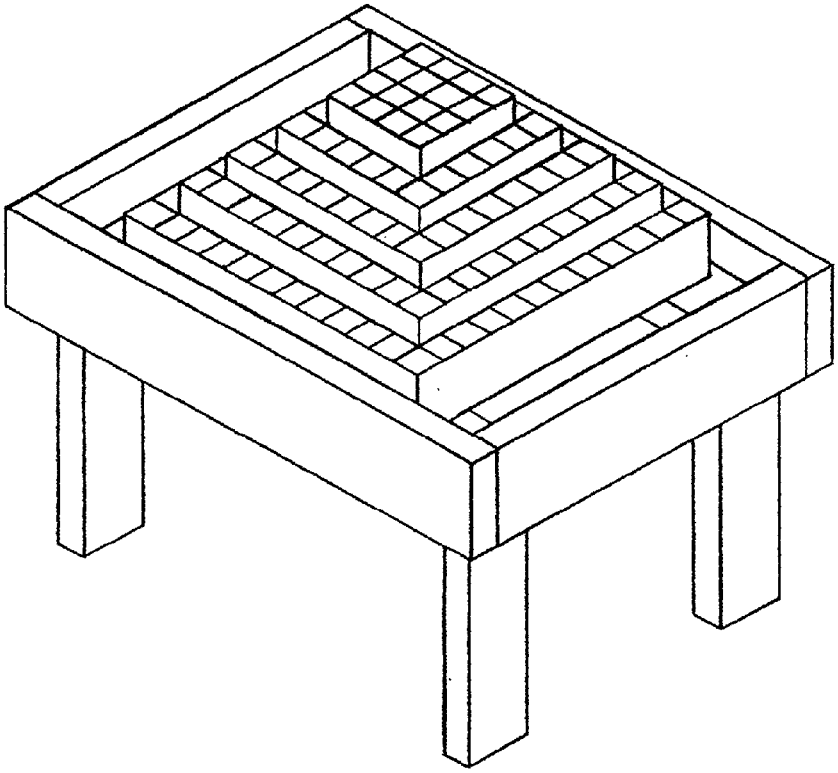
Figure 5:
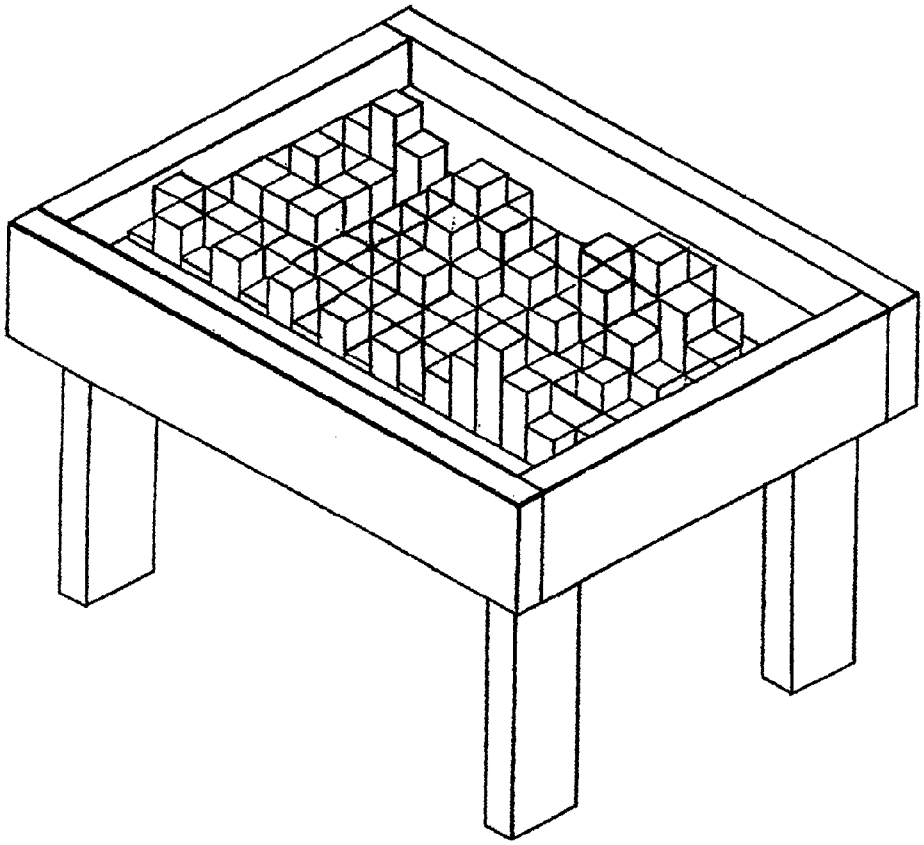
Figure 6:
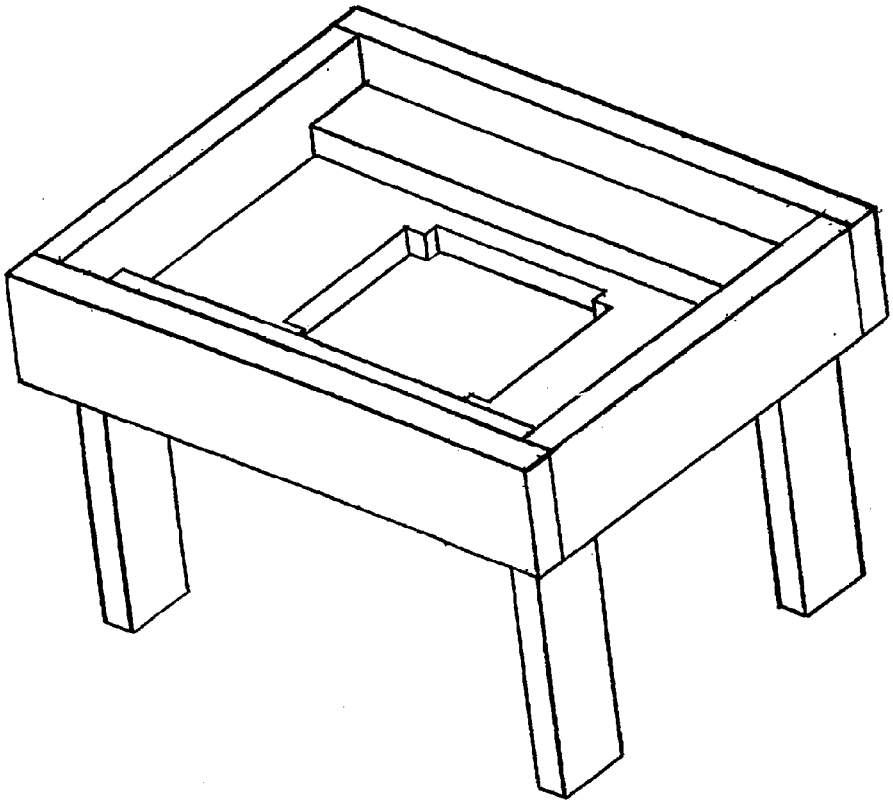
Figure 7:
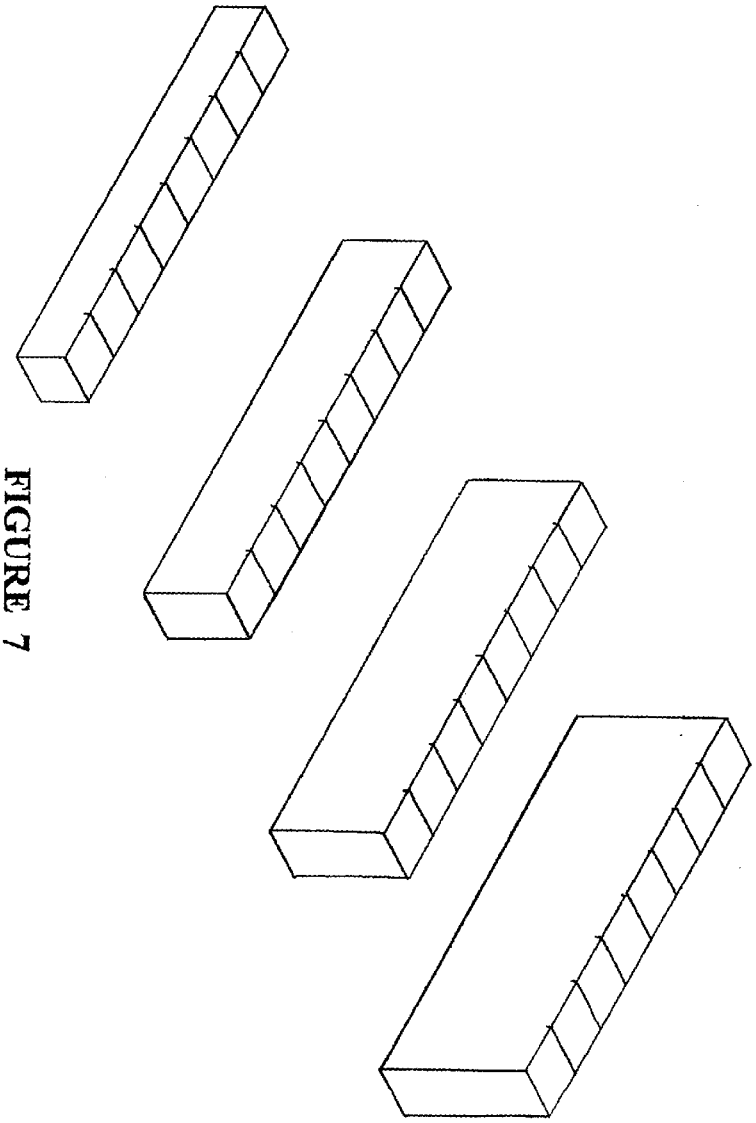
Figure 8:
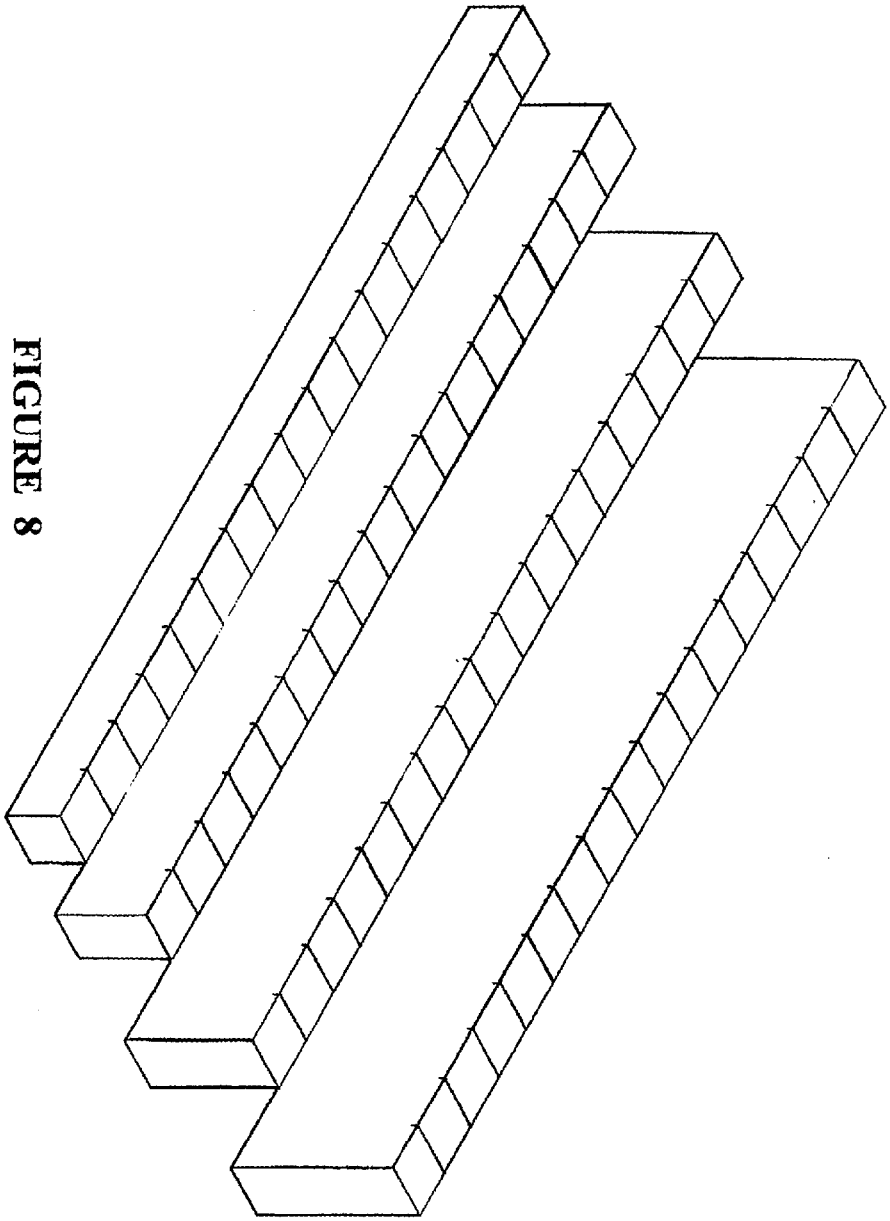
Figure 1:
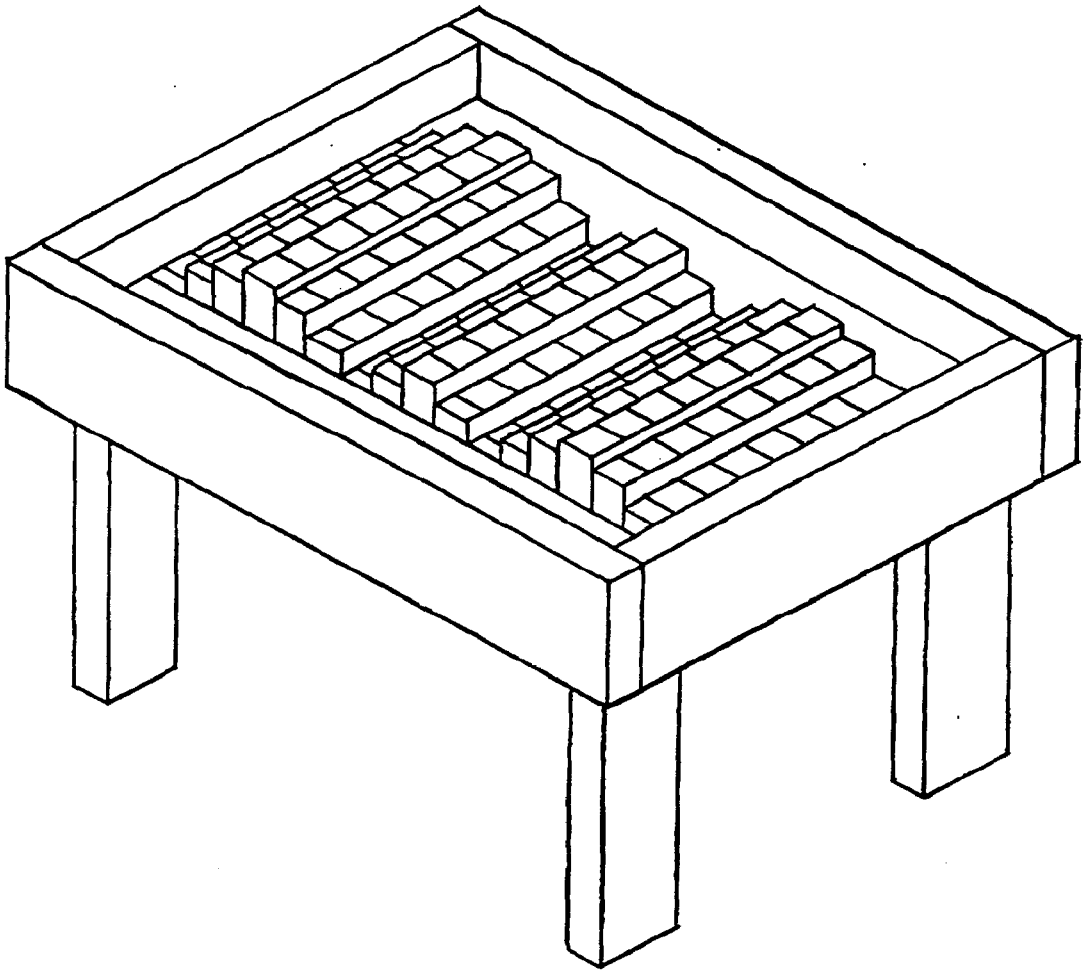
Figure 2:
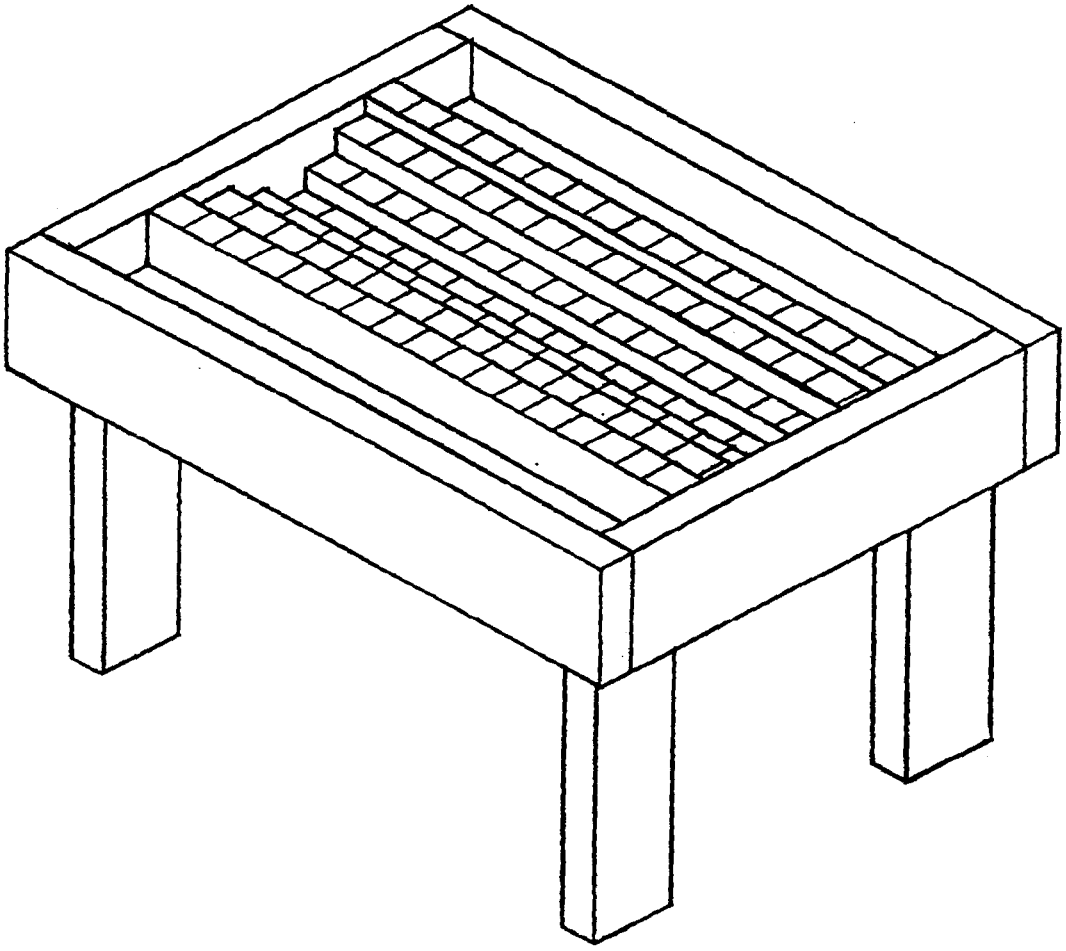
Figure 3:
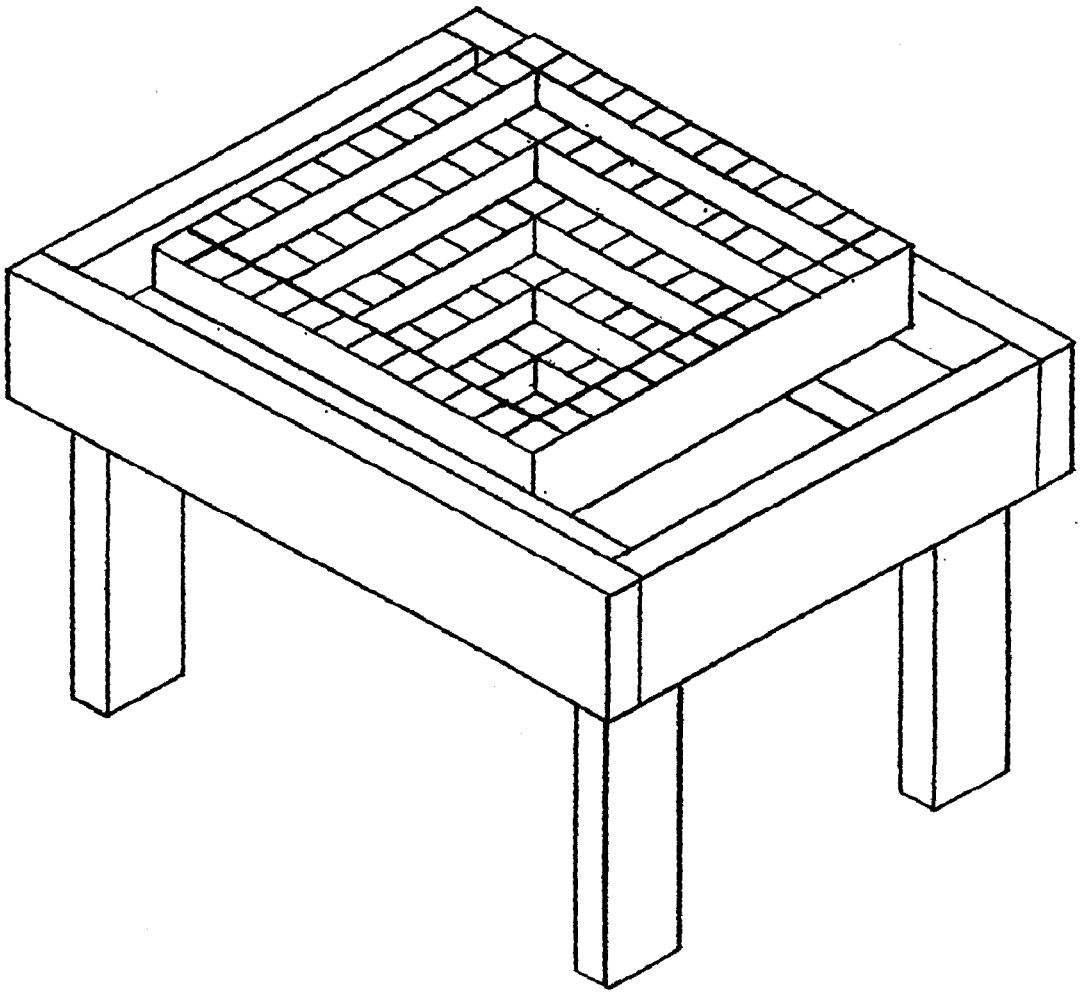
Figure 4:
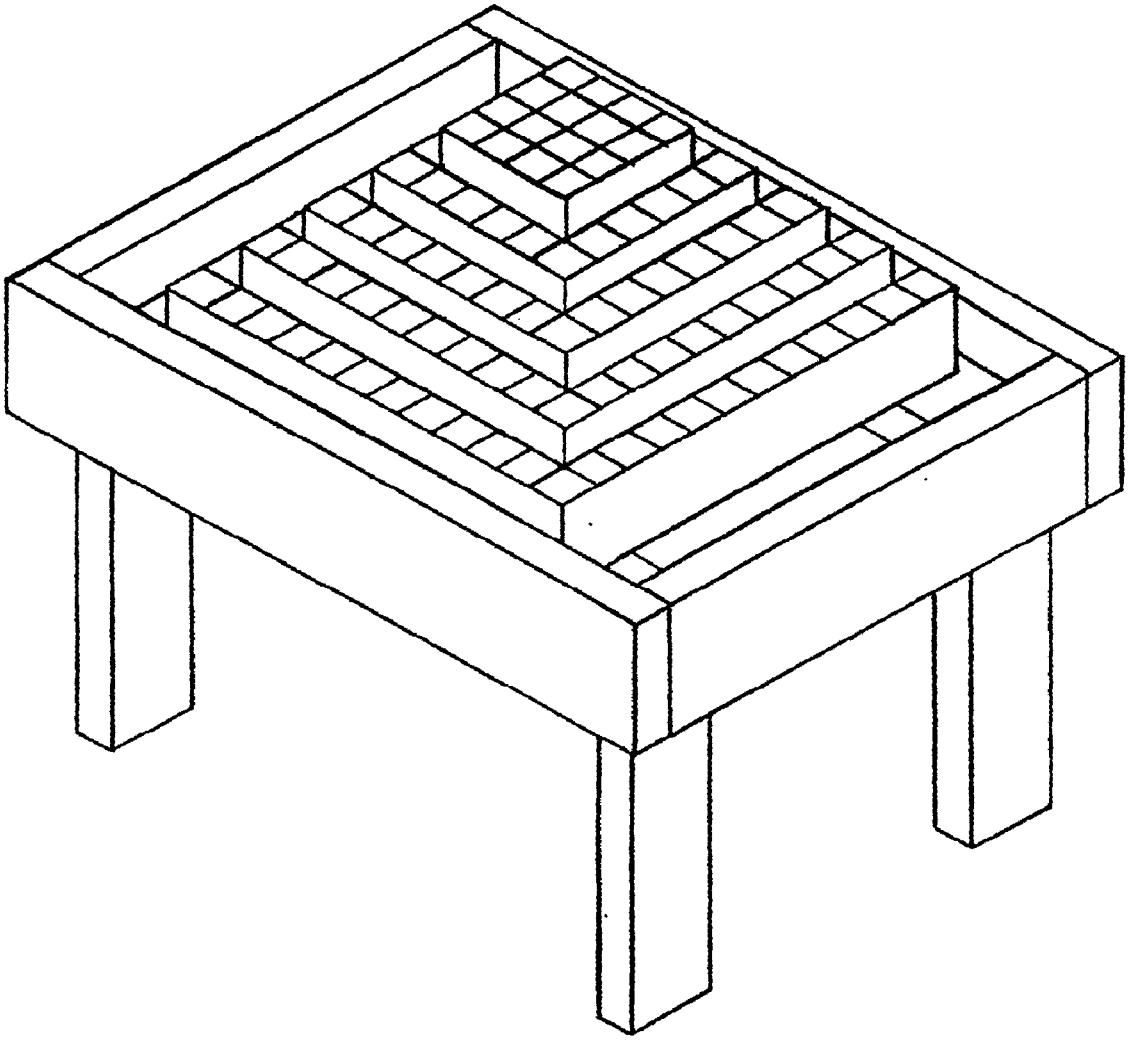
Figure 5:
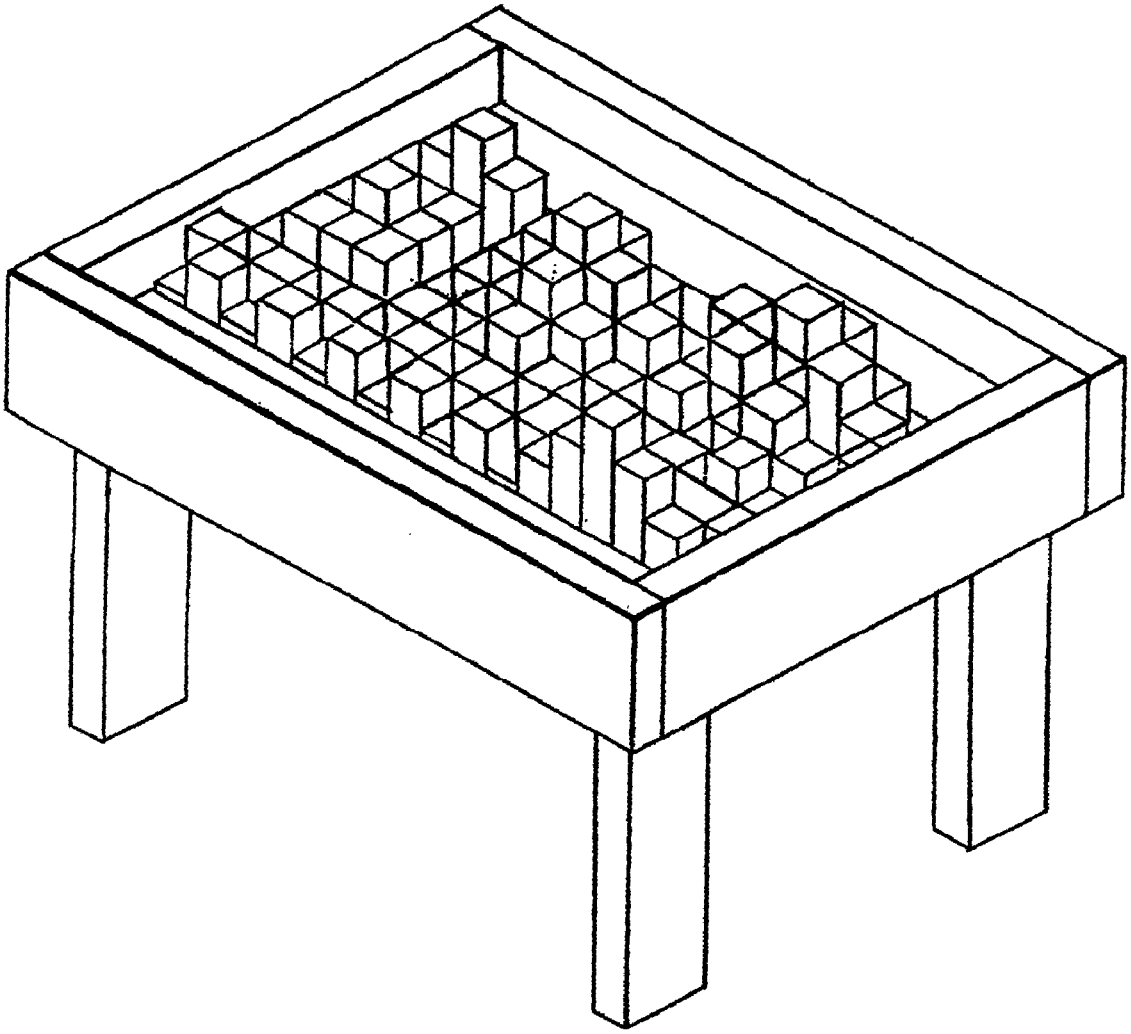
Figure 6:
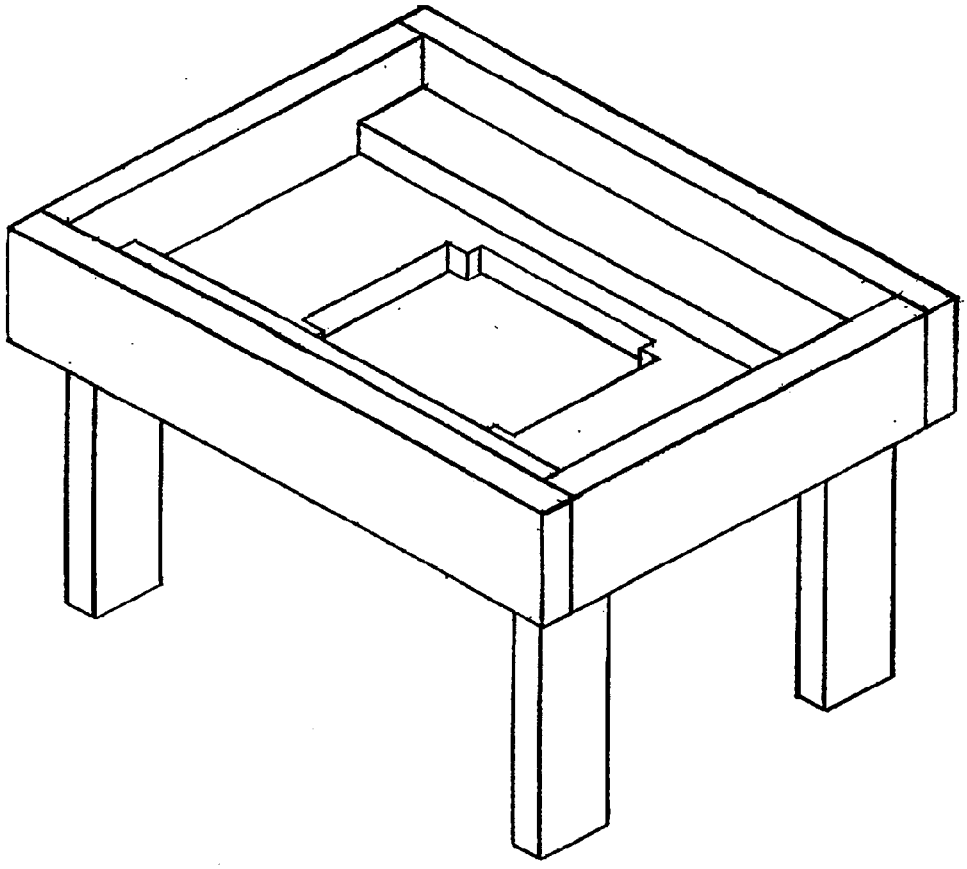
Figure 7:
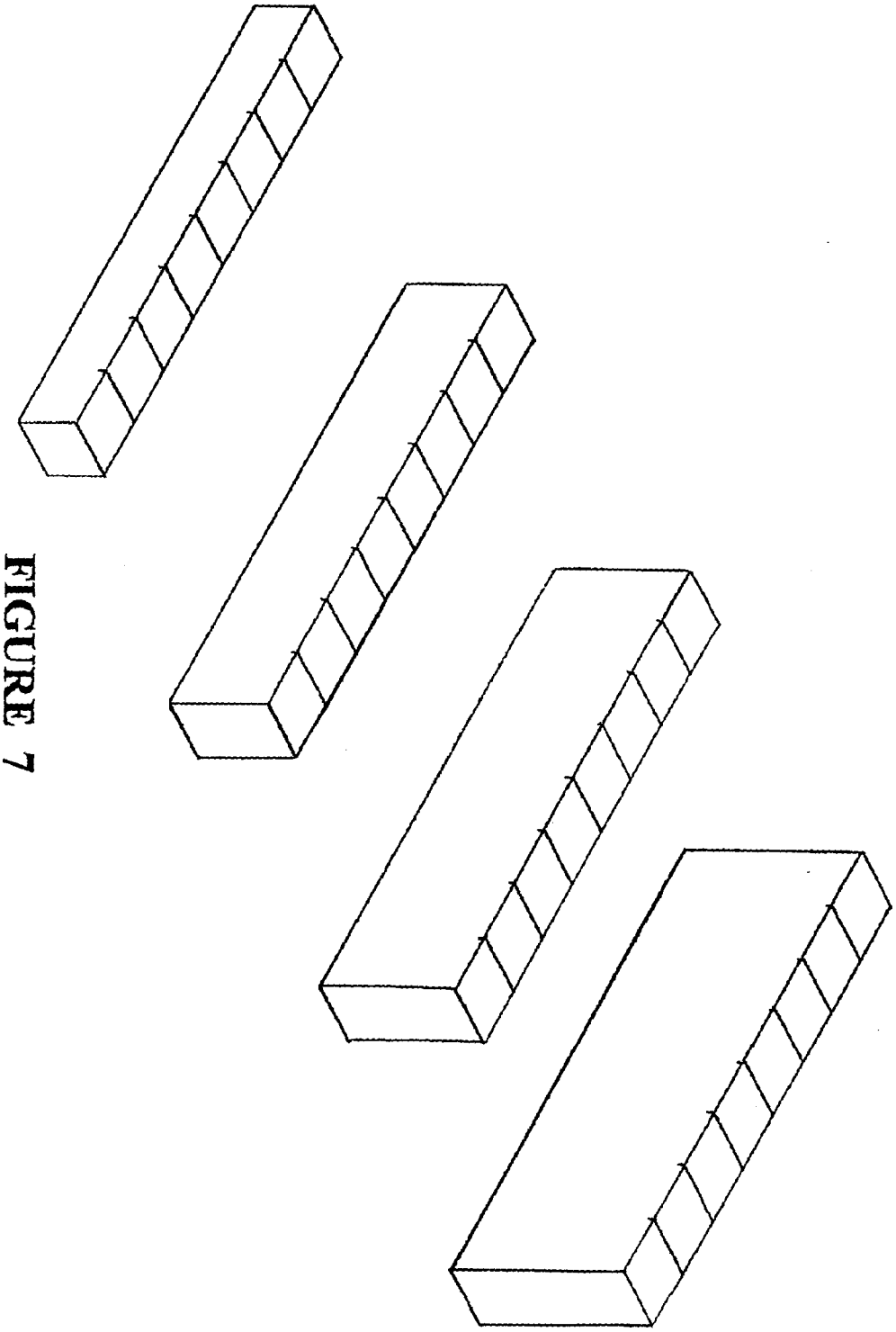
Figure 8:
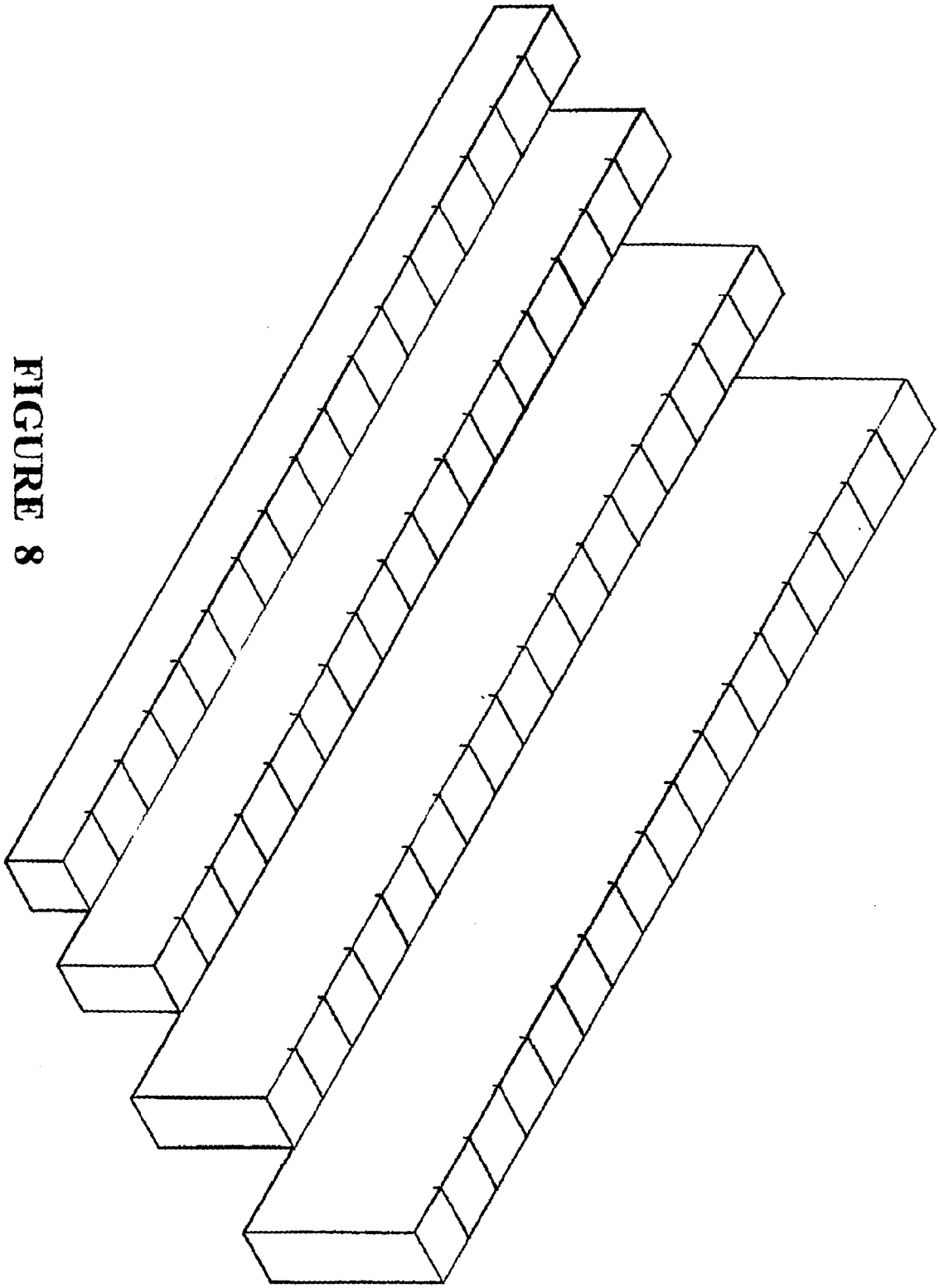
Figure 10:
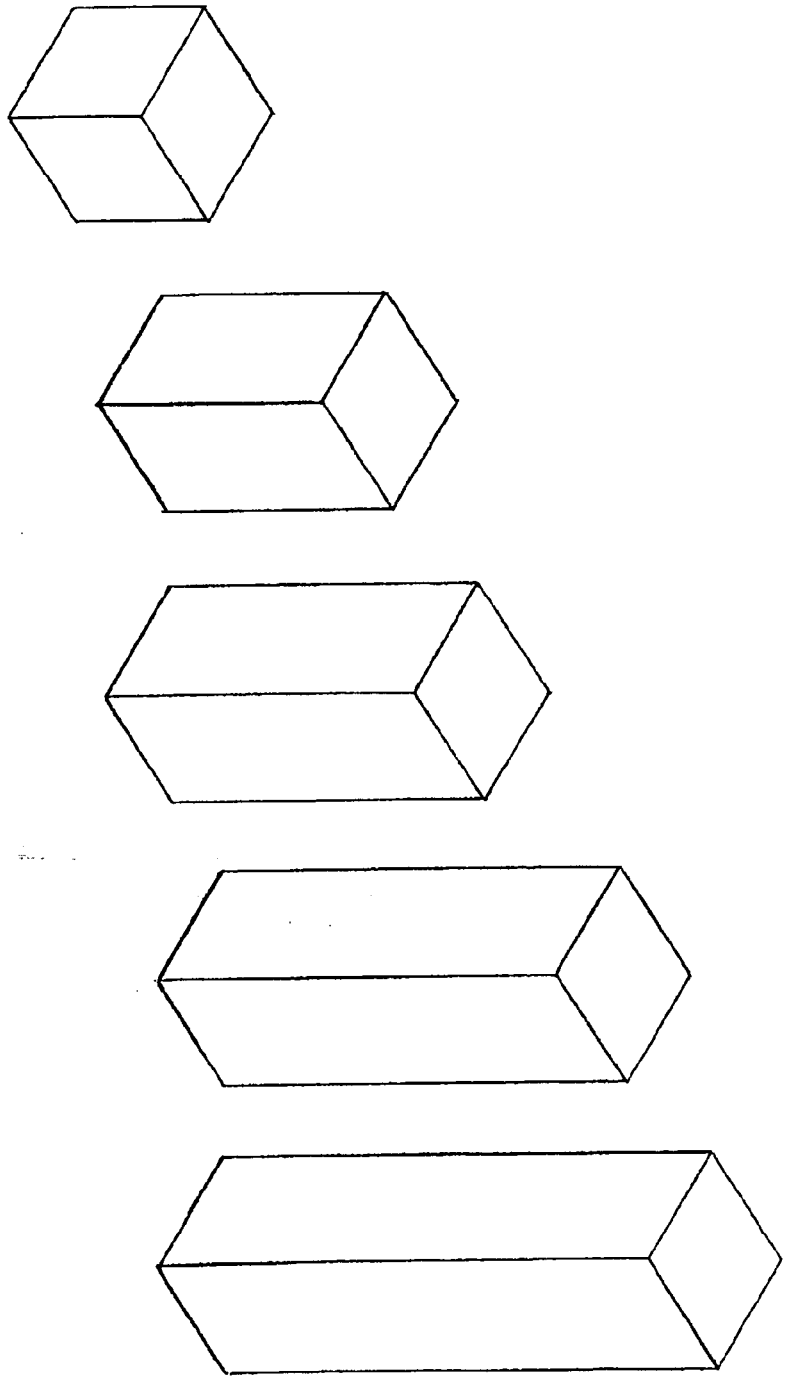

The ALL TERRAIN SPACIAL GAME BOARD CONFIGURATION (FIG. 5) is the most challenging of the configurations to play. Construction of this prototype consists of ¼" plywood (12" by 25½") that rests within the bottom shelving of Spacial Game Board Table (FIG. 6). The lumbers that form the playing surface rest upon the plywood. The lumbers are made from (2" by 2") wood, which is actually (1.5"×1.5") and stand upright on the longitudinal axis (FIG. 10) with quantity and height as follows: 1 (5.5" tall), 9 (4.5" tall), 23 (3.5" tall), 51 (2.5" tall), and 52 (1.5" tall). The lumbers are set on the game board table and form the appearance of random hilly terrain, maximizing the difficulty in diagonal line discernment.

The number of lumbers can be reduced to 64 and a two-player game can be created. A Spacial Game Board Box Configuration that is similar to the top of the Spacial Game Board Table supports these lumbers and its interior shelving holds the captured pieces. The Spacial Game Board Box may be placed on a coffee table or other structure close to 17" tall.

The Sixteen Player Competition Spacial Game Board Box Configuration has a super structure that is outlined in the shape of a cross where each leg of the cross contains 136 squares and, shelving for captured pieces. The area of intersection with the legs contains 64 squares.

Each winner of the four-player game at each leg plays a continuation with his remaining pieces and the winner of this portion of the competition is the champion of the competition. There may be more than 5 lengths of surface lumbers so as to create larger hills on enhanced versions.

The computer-generated version of the All Terrain Spacial Game Board configuration can accommodate various super structure shapes and have more than 5 surface lumber heights. Color-graphics allows for the creation of various scenes such as hills with blue sky and the playing pieces as elements of a more true-to-life military. Color-graphics also allows for the creation of a space scene and the levels are various locations in outer space with the playing pieces represented as space ships.

The Spacial Game Board as a hard copy or computer generated configuration is used for playing Spacial Chess and Spacial Checkers or any game based on Spacial Chess or Spacial Checkers with the goal of mastering the challenges of spatiality.

What is claimed is:

1. A four-player board game for playing chess or checkers comprising:

a plurality of playing pieces;

a plurality of elongated lumber pieces each having a length, a height and a width, said width and height of each lumber piece defining surfaces along the sides of the lumber pieces, said lumber pieces all having the same length and width;

said lumber pieces having different heights, wherein a first set of lumber pieces having a first height, a second set of lumber pieces having a second height which is greater than said first height, a third set of lumber pieces having a third height which is greater than said second height, and a fourth set of lumber pieces having a fourth height which is greater than said third height, said length of said lumber pieces is greater than said width and said heights;

said surface along the width of each lumber piece having demarcations defining a row of equally sized squares along the entire surface, said squares sized to receive said playing pieces;

said lumber pieces assembled together to form a game board having a playing surface with rows and columns of squares wherein the side surfaces of the lumber pieces, defining the different heights, being adjacent to one another, and the side surfaces of the lumber pieces, defining the widths, being placed face up to create the playing surface;

said playing surface having rows of different levels, wherein said first set of lumber pieces placed adjacent each other define innermost rows having a lowest level, said second set of lumber pieces placed on two opposite sides adjacent and outside of the first set of lumber pieces define second rows having a higher level than said innermost rows, said third set of lumber pieces placed on two opposite sides adjacent and outside of the second set of lumber pieces define third rows having a higher level than said second rows, and said fourth set of lumber pieces placed on two opposite sides adjacent and outside of the third set of lumber pieces define outermost rows having a highest level.

2. The board game of claim 1 further comprising a table having a top, said top having an open box structure comprising two interior shelves on opposite interior sides of the box for storing captured playing pieces, said box structure also having a recessed surface between the interior shelves for supporting the assembled game board, the side surfaces of the interior shelves provide lateral support for the lumber pieces.

3. The table of claim 2 further comprising a table height of 17.5" and two interior shelves 25" long and 3.5" wide.

4. The board game of claim 1, wherein the squares are non-colored, and are 1.5"×1.5" in size.

5. The board game of claim 1, wherein said game board comprises eight lumber pieces, each lumber piece having a length of 25.5" and a width of 1.5", resulting in a game board having 136 squares consisting of 17 columns of various height and 8 rows of constant height.

6. The board game of claim 1, wherein the demarcations are ¼" grooves.

7. The board game of claim 1 wherein the height of the first set of lumber pieces is 1.25", the height of the second set of lumber pieces is 2.25", the height of the third set of lumber pieces is 3.25" and the height of the fourth set of lumber pieces is 4".

8. The board game of claim 1, wherein said game board comprises seventeen lumber pieces, each lumber piece having a length of 12" and a width of 1.5", resulting in a game board having 136 squares consisting of 17 columns of constant height and 8 rows of various heights.

9. The board game of claim 1 wherein the height of the first set of lumber pieces is 1.5", the height of the second set of lumber pieces is 2.5", the height of the third set of lumber pieces is 3.5" and the height of the fourth set of lumber pieces is 4".

10. A four-player board game for playing chess or checkers comprising:

a plurality of playing pieces:

a solid one-piece game board formed from a plurality of lumber pieces attached together, said solid one-piece game board having a pyramidal shape with a four-sided square base, said game board having playing surfaces formed from said lumber pieces attached together to form a plurality of four-sided square shaped rings, each square shaped ring having a different side length, and each square shaped ring arranged concentrically to form a plurality of ringed steps of different vertical levels to create said pyramidal shape;

said game board having two playing surfaces on opposite sides of the game board comprising:

a first playing surface which steps upward from the outermost concentric ringed step, which is the lowest step, to the inner-most concentric ringed step which is the highest step at the center of the first playing surface;

and a second playing surface which steps downward from the outermost concentric ringed step, which is the highest step, to the innermost concentric ringed step which is the lowest step at the center of the second playing surface, wherein a particular playing surface is chosen for play by flipping over the pyramidal shape game board so that either the first playing surface or the second playing surface is positioned face-up;

said surface along each step is demarcated into squares, said squares are sized to receive said playing pieces.

11. The board game of claim 10, wherein the squares are non-colored, and are 1.5"×1.5" in size.

12. The board game of claim 10, wherein the demarcations are ¼" grooves.

13. The board game of claim 10, wherein each ringed step is made of four lumber pieces 1.5" wide, each lumber piece having a length corresponding to the length of one side of that particular ring, said game board having five ringed steps:

a first ringed step having lengths of 6"×6", and having 12 non-colored squares on one playing surface and 12 non-colored squares on the opposite playing surface;

a second ringed step having lengths of 9"×9", and having 20 non-colored squares on one playing surface and 20 non-colored squares on the opposite playing surface;

a third ringed step having lengths of 12"×12", and having 28 non-colored squares on one playing surface and 28 non-colored squares on the opposite playing surface;

a fourth ringed step having lengths of 15"×15", and having 36 non-colored squares on one playing surface and 36 non-colored squares on the opposite playing surface;

a fifth ringed step having lengths of 18"×18", and having 44 non-colored squares on one playing surface and 44 non-colored squares on the opposite playing surface.

14. The board game of claim 10, wherein the pyramidal top interior and exterior face are made from a lumber piece 3"×3" square having 4 non-colored squares on each of the interior face and the exterior face.

15. The board game of claim 10, wherein the total number of squares on the first playing surface is 144, and the total number of squares on the second playing surface is 144.

16. The board game of claim 10 further comprising a table having a top, said top having an open box structure comprising two interior shelves on opposite interior sides of the box for storing captured playing pieces, said box structure also having a recessed surface between the interior shelves, interior shelves and recessed surface between interior shelves support the pyramidal shape.

17. The table of claim 16 further comprising a table height of 17.5" and two interior shelves 25" long and 3.5" wide.

18. A board game of claim 10 further comprising a mounting ring in lieu of said table;

said mounting ring allows the pyramidal shape to sit on the top of the ring and whose interior slides over the outside of the mounting ring and a level rests upon the mounting ring or, when the pyramidal shape is flipped over, the exterior sides of the pyramidal shape slide within the interior sides of the mounting ring and a level rests upon the mounting ring;

said rectangular mounting ring has a height 5.5", width 12" at outside, length 12" at outside and a wall thickness of 1.5".

19. A four-player board game for playing chess or checkers comprising:

a plurality of playing pieces;

a plurality of elongated lumber pieces each having a length, and square cross-sectional area;

said lumber pieces assembled together to form a game board having a playing surface, wherein each lumber piece stands upright on its cross-sectional area, the top square cross-sectional area on each lumber piece defines a playing square on the playing surface, and sized to receive a playing piece, and the length of each lumber piece determines the height of the playing square;

said lumber pieces having different heights, wherein a first set of lumber pieces having a first height, a second set of lumber pieces having a second height which is greater than said first height, a third set of lumber pieces having a third height which is greater than said second height, and a fourth set of lumber pieces having a fourth height which is greater than said third height, and a fifth set of lumber pieces having a fifth height which is greater than said fourth height;

said playing surface consisting of 136 playing squares of different heights, and said playing squares arranged in rows and columns consisting of eight rows of various height variation and seventeen columns of various height variation and a base for supporting said game board.

20. The game board of claim 19 further comprising the quantity of said lumber pieces is 52 for the first height, 51 for the second height, 23 for the third height, 9 for the fourth height, and 1 for the fifth height.

21. The game board of claim 19 further comprising a base 12" wide, 25.5" long, and 0.25" thick that the lumbers stand upon.

22. The game board of claim 19 further comprising lumber pieces whose cross-section is 1.5"×1.5".

23. The game board of claim 19 further comprising lumber pieces whose various lengths are 1.5" for the first height, 3" for the second height, 4.5" for the third height, 6" for the fourth height, and 7.5" for the fifth height.

24. The board game of claim 19 further comprising a table having a top, said top having an open box structure comprising two interior shelves on opposite interior sides of the box for storing captured playing pieces, said box structure also having a recessed surface between the interior shelves for supporting the assembled game board, the side surfaces of the interior shelves provide lateral support for the lumber pieces.

25. The table of claim 24 further comprising a table height of 17.5" and two interior shelves 25" long and 3.5" wide.

* * * * *